US007917048B2

(12) United States Patent
Ito

(10) Patent No.: US 7,917,048 B2
(45) Date of Patent: Mar. 29, 2011

(54) IMAGE FORMING APPARATUS AND ELECTROMAGNETIC INDUCTION HEATING TYPE FIXING DEVICE HAVING MAGNETIC FLUX REGULATING SECTION

(75) Inventor: Masazumi Ito, Toyohashi (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 511 days.

(21) Appl. No.: 12/073,338

(22) Filed: Mar. 4, 2008

(65) Prior Publication Data

US 2008/0279577 A1 Nov. 13, 2008

(30) Foreign Application Priority Data

May 10, 2007 (JP) ..... 2007-125748

(51) Int. Cl.
*G03G 15/20* (2006.01)

(52) U.S. Cl. ..... 399/67; 399/122; 399/328; 219/216

(58) Field of Classification Search ..... 399/67, 399/122, 328; 219/216
See application file for complete search history.

(56) References Cited

U.S. PATENT DOCUMENTS

| | | | | |
|---|---|---|---|---|
| 2003/0128998 | A1* | 7/2003 | Nishi | 399/67 |
| 2004/0136761 | A1* | 7/2004 | Asakura et al. | 399/328 |

FOREIGN PATENT DOCUMENTS

| | | | |
|---|---|---|---|
| JP | 61-128665 | U | 8/1986 |
| JP | 06-258978 | | 9/1994 |
| JP | 10-74009 | A | 3/1998 |
| JP | 10-207286 | | 8/1998 |
| JP | 2000-162910 | | 6/2000 |
| JP | 2004-272157 | | 9/2004 |
| JP | 2005-092069 | | 4/2005 |
| JP | 2005-351936 | | 12/2005 |
| JP | 2006-195408 | A | 7/2006 |

OTHER PUBLICATIONS

Machine tranlsation of JP-2004-272157.*
Office Action (Preliminary Notice of Rejection) in JP 2007-125748 dated Apr. 28, 2009, and an English Translation thereof.

* cited by examiner

*Primary Examiner* — David M Gray
*Assistant Examiner* — G. M. Hyder
(74) *Attorney, Agent, or Firm* — Buchanan Ingersoll & Rooney PC

(57) ABSTRACT

A fixing member having an outer peripheral surface brought in pressure contact with a sheet, an induction coil along the member, and a high frequency power source section that heats the heat generating layer of the fixing member by supplying an alternating current to the induction coil. A magnetic flux regulating section that restricts the generation of heat in a specified region of the fixing member in the widthwise direction of the sheet is provided. Image regions occupied by the image to be fixed are detected in the widthwise direction of the sheet. Control of specifying the region in which the generation of heat should be restricted for the magnetic flux regulating section is executed so that only regions corresponding to the image regions of the fixing member are substantially heated in the widthwise direction of the sheet, sheet-by-sheet according to the result of detection.

20 Claims, 19 Drawing Sheets

IMAGE FORMING APPARATUS AND ELECTROMAGNETIC INDUCTION HEATING TYPE FIXING DEVICE HAVING MAGNETIC FLUX REGULATING SECTION

This application is based on an application No. 2007-125748 filed in Japan, the contents of which are hereby incorporated by reference.

BACKGROUND OF THE INVENTION

The present invention relates to fixing devices and, in particular, to an electromagnetic induction heating type fixing device.

The present invention relates also to an image forming apparatus having an electromagnetic induction heating type fixing device.

In general, the electromagnetic induction heating type fixing device of this kind has a fixing member (roller or belt) whose outer peripheral surface is brought in pressure contact with a sheet (paper) conveyed, and an induction coil for heating the fixing member by electromagnetic induction. By heating a metal layer of the fixing member by electromagnetic induction caused by the induction coil, a toner image adhering to the sheet is melted by the heat of the fixing member and fixed onto the sheet.

Conventionally, a system for preventing an excessive temperature rise in the end portion of the fixing member (i.e., a region through which a small-size sheet does not pass) by movably providing a magnetic flux shield member in the vicinity of the end portion of the fixing member in the widthwise direction of the sheet and moving the position of the magnetic flux shield member according to the dimension (width dimension) in the widthwise direction of the sheet to be subjected to image fixing has been proposed (refer to, for example, JP H10-74009 A and JP 2006-195408 A).

SUMMARY OF THE INVENTION

In the fixing devices of JP H10-74009 A and JP 2006-195408 A, only the portion, with which each sheet is actually brought in contact, of the outer peripheral surface of the fixing member is heated in the widthwise direction. In other words, the whole range of each sheet is heated in the widthwise direction.

However, the portion that needs to be actually heated in the widthwise direction of each sheet is only the image region to which the toner is adhering. Therefore, the fixing devices of JP H10-74009 A and JP 2006-195408 A have the problem that they are wastefully consuming energy.

Moreover, generally in the conventional fixing devices, the whole range of each sheet conveyed is heated in the conveyance direction of the sheet. For the above reasons, there is a problem that energy is wastefully consumed.

An object of the present invention is to provide a fixing device capable of heating only the image region of each sheet and therefore achieving energy conservation.

Another object of the present invention is to provide an image forming apparatus capable of heating only the image region of each sheet for image fixing and therefore achieving energy conservation.

In order to accomplish the object, a fixing device of the present invention comprises:

a fixing member that extends along a widthwise direction of a sheet conveyed and has an outer peripheral surface to be brought in pressure contact with the sheet;

an induction coil that is placed elongate in the widthwise direction of the sheet along the fixing member, for inductively heating a heat generating layer of the fixing member;

a high frequency power source section that heats the heat generating layer of the fixing member via the induction coil by supplying an alternating current to the induction coil;

a magnetic flux regulating section that restricts heating of a specified region of the fixing member in the widthwise direction of the sheet;

a first image region detecting section that detects an image region on the sheet occupied by an image to be fixed in the widthwise direction of the sheet; and a first control section that specifies a region in which generation of heat should be restricted for the magnetic flux regulating section so that only a region of the fixing member corresponding to the image region is substantially heated in the widthwise direction of the sheet, sheet-by-sheet according to a result of detection of the first image region detecting section.

It is noted that the verbal phrase of "substantially heat" means exclusion of the case where heating takes effect as a result of the diffraction of magnetic fluxes despite that the heating is restricted by the magnetic flux regulating section.

In the fixing device of the present invention, the first image region detecting section detects the image region on the sheet in the widthwise direction of the sheet. The first control section specifies the region in which the generation of heat should be restricted for the magnetic flux regulating section so that only the region corresponding to the image region of the fixing member is substantially heated in the widthwise direction of the sheet, sheet-by-sheet according to the result of detection of the first image region detecting section. The high frequency power source section supplies an alternating current to the induction coil, and the magnetic flux regulating section restricts the generation of heat in the specified region of the fixing member in the widthwise direction of the sheet. By this operation, only the region corresponding to the image region of the fixing member is substantially heated in the widthwise direction of the sheet, and the generation of heat in other regions is restricted. In the above state, the sheet is brought in pressure contact with the outer peripheral surface of the fixing member. As a result, only the image region of each sheet can be heated in the widthwise direction of the sheet. Therefore, energy conservation can be achieved.

In an another aspect, a fixing device of the present invention comprises:

a fixing member that extends along a widthwise direction of a sheet conveyed and has an outer peripheral surface to be brought in pressure contact with the sheet;

an induction coil that is placed elongate in the widthwise direction of the sheet along the fixing member, for inductively heating a heat generating layer of the fixing member;

a high frequency power source section that heats the heat generating layer of the fixing member via the induction coil by supplying an alternating current to the induction coil;

a magnetic flux regulating section that restricts heating of a specified region of the fixing member in the widthwise direction of the sheet;

a second image region detecting section that detects an image region on the sheet occupied by an image to be fixed in a conveyance direction of the sheet; and a second control section that specifies turning-on and -off of power supply to the induction coil for the high frequency power source section so that only the image region on the sheet is heated in the conveyance direction of the sheet, sheet-by-sheet according to a result of detection of the second image region detecting section.

In the fixing device of the present invention, the second image region detecting section detects the image region on the sheet occupied by the image to be fixed in the conveyance direction of the sheet. Then, the second control section instructs the high frequency power source section to turn on and off the power supply to the induction coil so that only the image region on the sheet is heated in the conveyance direction of the sheet, sheet-by-sheet according to the result of detection of the second image region detecting section. As a result, only the image region of each sheet can be heated in the conveyance direction of the sheet. Therefore, energy conservation can be achieved.

In the fixing device of one embodiment, the magnetic flux regulating section comprises:

a support member made of a nonmagnetic material placed elongate in the widthwise direction of the sheet along the fixing member and the induction coil;

a magnetic flux shield portion that is formed with a prescribed pattern on a surface of the support member and interrupts a magnetic flux directed from the induction coil toward the fixing member; and a displacement mechanism that displaces the support member having the magnetic flux shield portion relatively to the fixing member and the induction coil.

In the fixing device of the present one embodiment, the displacement mechanism can restrict the generation of heat in the specified region of the fixing member in the widthwise direction of the sheet by displacing the support member having the magnetic flux shield portion relative to the fixing member and the induction coil.

In the fixing device of one embodiment, the fixing member is a metal sleeve that extends elongate in the widthwise direction of the sheet, the support member is a cylindrical member placed so as to be brought in contact with an inner peripheral surface of the fixing member, the induction coil is placed inside the support member, the support member is divided into a first support member and a second support member in the widthwise direction of the sheet, and the magnetic flux shield portion is provided for each of the first support member and the second support member, and the displacement mechanism displaces the first support member and the second support member of the support member by independently rotating the members around a central axis of each of the members.

In the fixing device of the present one embodiment, the variations of the regions of the fixing member in which the generation of heat can be restricted in the widthwise direction of the sheet are increased.

In the fixing device of one embodiment, the pattern of the magnetic flux shield portion on the first support member comprises: a first pattern portion whose dimension in the direction of the central axis is gradually decreased from its total length as located farther away from a reference position on the support member toward one side in a circumferential direction; and a second pattern portion whose dimension in the direction of the central axis is gradually increased from zero to the total length as located farther away from the reference position toward the other side in the circumferential direction, the pattern of the magnetic flux shield portion on the second support member is formed symmetrically to the pattern of the magnetic flux shield portion on the first support member with respect to a boundary plane located between the first support member and the second support member, and the displacement mechanism is able to independently rotate the first support member and the second support member forwardly or reversely.

In this fixing device of the present one embodiment, the first support member and the second support member have the first pattern portion whose dimension in the direction of the central axis is gradually decreased from the total length as located farther away from the reference position on the support member to one side in the circumferential direction, and the second pattern portion whose dimension in the direction of the central axis is gradually increased from zero to the total length as located farther away from the reference position to the other side in the circumferential direction. Therefore, in order to make the displacement mechanism displace the first support member and the second support member to the respective target angular positions, it is proper to move the first support member and the second support member to the one side or the other side in the circumferential direction, preferably to the side where the required angle of rotation is smaller. Therefore, time required for the displacement-mechanism to displace the first support member and the second support member to the respective target angular positions is shortened.

In the fixing device of one embodiment, the first image region detecting section comparts the sheet into a plurality of areas in the widthwise direction of the sheet and detects whether or not each comparted area is occupied by the image that should be fixed, and each of the first and second patterns of the magnetic flux shield portion on the first support member and the second support member has the dimension in the direction of the central axis increased or decreased step-by-step in blocks defined in correspondence with the area as located farther away from the reference position in the circumferential direction.

In the fixing device of the present one embodiment, the first and second patterns of the magnetic flux shield portions on the first support member and the second support member have the dimensions in the direction of the central axis increased or decreased step-by-step in specified blocks in correspondence with the areas as located farther away from the respective reference positions. Therefore, it is proper for the displacement mechanism to rotate the first support member and the second support member to the one side or the other side in the circumferential direction every angle at which the dimension in the direction of the central axis of the first and second patterns of the magnetic flux shield portions is increased or decreased step-by-step. Therefore, the control of the angular positions of the first support member and the second support member is simplified.

In the fixing device of one embodiment, each of the first and second patterns of the magnetic flux shield portion on the first support member and the second support member has the dimension in the direction of the central axis linearly increased or decreased as located farther away from the reference position in the circumferential direction.

In the fixing device of the present one embodiment, the region in which the generation of heat of the fixing member can be restricted in the widthwise direction of the sheet can be continuously variably set.

In the fixing device of one embodiment, the first image region detecting section comprises:

a counting section that comparts the sheet into a plurality of areas in the widthwise direction of the sheet and detects an amount of image of each comparted area;

a memory section that stores the amount of image of each area detected by the counting section; and a determining section that determines whether or not the amount of image of each area exceeds a prescribed threshold value and determines that such an area where the amount of image exceeds the threshold value belongs to the image region.

In this case, the "amount of image" indicates the amount of toner in the case of, for example, a toner image. The "amount of image", which is defined for each area, corresponds to the image density (toner density in the case of, for example, a toner image).

In the fixing device of the present one embodiment, it is determined area-by-area whether or not the area belongs to the image region in the widthwise direction of the sheet. Therefore, detection of the image region on the sheet can be performed comparatively easily.

In the fixing device of one embodiment, the second image region detecting section comprises:

a counting section that comparts the sheet into a plurality of areas in the conveyance direction of the sheet and detects an amount of image of each comparted area;

a memory section that stores the amount of image of each area detected by the counting section; and a determining section that determines whether or not the amount of image of each area exceeds a prescribed threshold value and determines that such an area where the amount of image exceeds the threshold value belongs to the image region.

In the fixing device of the present one embodiment, it is determined area-by-area whether or not the area belongs to the image region in the conveyance direction of the sheet. Therefore, detection of the image region on the sheet can be performed comparatively easily.

When the temperature difference is excessively large in the sheet passing region of the fixing member where the sheet should pass, a trouble of the generation of wrinkles in the sheet after fixation possibly occurs.

Thus, in the fixing device of the present one embodiment, a temperature distribution obtaining section that obtains a temperature distribution of the fixing member in the widthwise direction of the sheet;

a passing region detecting section that preparatorily obtains a sheet passing region, through which the sheet should pass, of the fixing member sheet-by-sheet on a basis of a width dimension of the sheet conveyed; and a third control section that obtains a difference between a maximum temperature and a minimum temperature represented by the temperature distribution within the sheet passing region and permits the magnetic flux regulating section to heat whole area of the sheet passing region on the fixing member when the difference exceeds a prescribed threshold value.

In the fixing device of the present one embodiment, the temperature distribution obtaining section obtains the temperature distribution of the fixing member in the widthwise direction of the sheet. The third control section obtains the difference between the maximum temperature and the minimum temperature expressed by the temperature distribution within the sheet passing region, and executes control to permit the magnetic flux regulating section to heat the whole area of the sheet passing region on the fixing member when the difference exceeds the prescribed threshold value. Therefore, wrinkles can be prevented from generating in the sheet after fixation.

In the fixing device of one embodiment, the temperature distribution obtaining section comprises a plurality of temperature sensors that are arranged in the widthwise direction of the sheet oppositely to the fixing member and each detect a temperature of an opposite portion of the fixing member.

In this case, the phrase of "oppositely to the fixing member" of the temperature sensor includes both the case where the temperature sensor is put in contact with the fixing member and the case where the sensor is spaced apart from the fixing member. That is, the temperature sensor may be a contact type or a noncontact type.

In the fixing device of the present one embodiment, the difference between the maximum temperature and the minimum temperature can be obtained simply and accurately.

In the fixing device of one embodiment, the temperature distribution obtaining section obtains by simulation a temperature distribution of the fixing member in the widthwise direction of the sheet.

In the fixing device of the present one embodiment, the parts cost can be reduced by reducing the number of temperature sensors.

An image forming apparatus of the present invention comprises:

an image forming section that forms a toner image by making toner adhere to a sheet;

a fixing member that extends along a widthwise direction of the sheet conveyed and has an outer peripheral surface brought in pressure contact with the sheet to which the toner image has adhered;

an induction coil that is placed elongate in the widthwise direction of the sheet along the fixing member, for inductively heating a heat generating layer of the fixing member;

a high frequency power source section that heats the heat generating layer of the fixing member via the induction coil by supplying an alternating current to the induction coil;

a magnetic flux regulating section that restricts heating of a specified region of the fixing member in the widthwise direction of the sheet;

a first image region detecting section that detects an image region on the sheet occupied by an image to be fixed in the widthwise direction of the sheet; and a first control section that specifies a region in which generation of heat should be restricted for the magnetic flux regulating section so that only a region corresponding to the image region of the fixing member is substantially heated in the widthwise direction of the sheet, sheet-by-sheet according to a result of detection of the first image region detecting section.

It is noted that the verbal phrase of "substantially heat" means exclusion of the case where heating takes effect as a result of the diffraction of magnetic fluxes despite that the heating is restricted by the magnetic flux regulating section.

In the image forming apparatus of the present invention, the image forming section forms a toner image by making toner adhere to the sheet. Meanwhile, the first image region detecting section detects the image region on the sheet in the widthwise direction of the sheet. The first control section specifies the region in which the generation of heat should be restricted for the magnetic flux regulating section so that only the region corresponding to the image region of the fixing member is substantially heated in the widthwise direction of the sheet, sheet-by-sheet according to the result of detection of the first image region detecting section. The high frequency power source section supplies an alternating current to the induction coil, and the magnetic flux regulating section restricts the generation of heat in the specified region of the fixing member in the widthwise direction of the sheet. By this operation, only the region corresponding to the image region of the fixing member is substantially heated in the widthwise direction of the sheet, and the generation of heat in other regions is restricted. In the above state, the sheet to which the toner image has adhered is brought in pressure contact with the outer peripheral surface of the fixing member. As a result, only the image region of each sheet can be heated for fixation in the widthwise direction of the sheet. Therefore, energy conservation can be achieved.

In an another aspect, an image forming apparatus of the present invention comprises:

an image forming section that forms a toner image by making toner adhere to a sheet;

a fixing member that extends along a widthwise direction of the sheet conveyed and has an outer peripheral surface brought in pressure contact with the sheet to which the toner image has adhered;

an induction coil that is placed elongate in the widthwise direction of the sheet along the fixing member, for inductively heating a heat generating layer of the fixing member;

a high frequency power source section that heats the heat generating layer of the fixing member via the induction coil by supplying an alternating current to the induction coil;

a magnetic flux regulating section that restricts heating of a specified region of the fixing member in the widthwise direction of the sheet;

a second image region detecting section that detects an image region on the sheet occupied by an image to be fixed in a conveyance direction of the sheet; and a second control section that specifies turning-on and -off of power supply to the induction coil for the high frequency power source section so that only the image region on the sheet is heated in the conveyance direction of the sheet, sheet-by-sheet according to a result of detection of the second image region detecting section.

In the image forming apparatus of the present invention, the image forming section forms a toner image by making toner adhere to the sheet. Meanwhile, the second image region detecting section detects the image region on the sheet occupied by the image to be fixed in the conveyance direction of the sheet. Then, the second control section instructs the high frequency power source section to turn on and off the power supply to the induction coil so that only the image region on the sheet is heated in the conveyance direction of the sheet, sheet-by-sheet according to the result of detection of the second image region detecting section. As a result, only the image region of each sheet can be heated in the conveyance direction of the sheet. Therefore, energy conservation can be achieved.

In the image forming apparatus of one embodiment, the magnetic flux regulating section comprises:

a support member made of a nonmagnetic material placed elongate in the widthwise direction of the sheet along the fixing member and the induction coil;

a magnetic flux shield portion that is formed with a prescribed pattern on a surface of the support member and interrupts a magnetic flux directed from the induction coil toward the fixing member; and a displacement mechanism that displaces the support member having the magnetic flux shield portion relatively to the fixing member and the induction coil.

In the image forming apparatus of the present one embodiment, the displacement mechanism can restrict the generation of heat in the specified region of the fixing member in the widthwise direction of the sheet by displacing the support member having the magnetic flux shield portion relative to the fixing member and the induction coil.

In the image forming apparatus of one embodiment, the fixing member is a metal sleeve that extends elongate in the widthwise direction of the sheet, the support member is a cylindrical member placed so as to be brought in contact with an inner peripheral surface of the fixing member, the induction coil is placed inside the support member, the support member is divided into a first support member and a second support member in the widthwise direction of the sheet, and the magnetic flux shield portion is provided for each of the first support member and the second support member, and the displacement mechanism displaces the first support member and the second support member of the support member by independently rotating the members around a central axis of each of the members.

In the image forming apparatus of the present one embodiment, the variations of the regions of the fixing member in which the generation of heat can be restricted in the widthwise direction of the sheet are increased.

In the image forming apparatus of one embodiment, the pattern of the magnetic flux shield portion on the first support member comprises: a first pattern portion whose dimension in the direction of the central axis is gradually decreased from its total length as located farther away from a reference position on the support member toward one side in a circumferential direction; and a second pattern portion whose dimension in the direction of the central axis is gradually increased from zero to the total length as located farther away from the reference position toward the other side in the circumferential direction, the pattern of the magnetic flux shield portion on the second support member is formed symmetrically to the pattern of the magnetic flux shield portion on the first support member with respect to a boundary plane located between the first support member and the second support member, and the displacement mechanism is able to independently rotate the first support member and the second support member forwardly or reversely.

In the image forming apparatus of the present one embodiment, the first support member and the second support member have the first pattern portion whose dimension in the direction of the central axis is gradually decreased from the total length as located farther away from the reference position on the support member to one side in the circumferential direction, and the second pattern portion whose dimension in the direction of the central axis is gradually increased from zero to the total length as located farther away from the reference position to the other side in the circumferential direction. Therefore, in order to make the displacement mechanism displace the first support member and the second support member to the respective target angular positions, it is proper to move the first support member and the second support member to the one side or the other side in the circumferential direction, preferably to the side where the required angle of rotation is smaller. Therefore, time required for the displacement mechanism to displace the first support member and the second support member to the respective target angular positions is shortened.

In the image forming apparatus of one embodiment, the first image region detecting section comparts the sheet into a plurality of areas in the widthwise direction of the sheet and detects whether or not each comparted area is occupied by the image that should be fixed, and each of the first and second patterns of the magnetic flux shield portion on the first support member and the second support member has the dimension in the direction of the central axis increased or decreased step-by-step in blocks defined in correspondence with the area as located farther away from the reference position in the circumferential direction.

In the image forming apparatus of the present one embodiment, the first and second patterns of the magnetic flux shield portions on the first support member and the second support member have the dimensions in the direction of the central axis increased or decreased step-by-step in specified blocks in correspondence with the areas as located farther away from the respective reference positions. Therefore, it is proper for the displacement mechanism to rotate the first support member and the second support member to the one side or the other side in the circumferential direction every angle at which the dimension in the direction of the central axis of the first and second patterns of the magnetic flux shield portions is increased or decreased step-by-step. Therefore, the control of the angular positions of the first support member and the second support member is simplified.

In the image forming apparatus of one embodiment, each of the first and second patterns of the magnetic flux shield portion on the first support member and the second support member has the dimension in the direction of the central axis continuously increased or decreased as located farther away from the reference position in the circumferential direction.

In the image forming apparatus of the present one embodiment, the region in which the generation of heat of the fixing member can be restricted in the widthwise direction of the sheet can be continuously variably set.

In the image forming apparatus of one embodiment, the first image region detecting section comprises:

a counting section that comparts the sheet into a plurality of areas in the widthwise direction of the sheet and detects an amount of image of each comparted area;

a memory section that stores the amount of image of each area detected by the counting section; and a determining section that determines whether or not the amount of image of each area exceeds a prescribed threshold value and determines that such an area where the amount of image exceeds the threshold value belongs to the image region.

In this case, the "amount of image" indicates the amount of toner in the case of, for example, a toner image. The "amount of image", which is defined for each area, corresponds to the image density (toner density in the case of, for example, a toner image).

In the image forming apparatus of the present one embodiment, it is determined area-by-area whether or not the area belongs to the image region in the widthwise direction of the sheet. Therefore, detection of the image region on the sheet can be performed comparatively easily.

In the image forming apparatus of one embodiment, the second image region detecting section comprises:

a counting section that comparts the sheet into a plurality of areas in the conveyance direction of the sheet and detects an amount of image of each comparted area;

a memory section that stores the amount of image of each area detected by the counting section; and a determining section that determines whether or not the amount of image of each area exceeds a prescribed threshold value and determines that such an area where the amount of image exceeds the threshold value belongs to the image region.

In the image forming apparatus of the present one embodiment, it is determined area-by-area whether or not the area belongs to the image region in the conveyance direction of the sheet. Therefore, detection of the image region on the sheet can be performed comparatively easily.

When the temperature difference is excessively large in the sheet passing region of the fixing member where the sheet should pass, a trouble of the generation of wrinkles in the sheet after fixation possibly occurs.

Thus, in the image forming apparatus of one embodiment, a temperature distribution obtaining section that obtains a temperature distribution of the fixing member in the widthwise direction of the sheet;

a passing region detecting section that preparatorily obtains a sheet passing region, through which the sheet should pass, of the fixing member sheet-by-sheet on a basis of a width dimension of the sheet conveyed; and a third control section that obtains a difference between a maximum temperature and a minimum temperature represented by the temperature distribution within the sheet passing region and permits the magnetic flux regulating section to heat whole area of the sheet passing region on the fixing member when the difference exceeds a prescribed threshold value.

In the image forming apparatus of the present one embodiment, the temperature distribution obtaining section obtains the temperature distribution of the fixing member in the widthwise direction of the sheet. The third control section obtains the difference between the maximum temperature and the minimum temperature expressed by the temperature distribution within the sheet passing region, and executes control to permit the magnetic flux regulating section to heat the whole area of the sheet passing region on the fixing member when the difference exceeds the prescribed threshold value. Therefore, wrinkles can be prevented from generating in the sheet after fixation.

In the image forming apparatus of one embodiment, the temperature distribution obtaining section comprises a plurality of temperature sensors that are arranged in the widthwise direction of the sheet oppositely to the fixing member and each detect a temperature of an opposite portion of the fixing member.

In this case, the phrase of "oppositely to the fixing member" of the temperature sensor includes both the case where the temperature sensor is put in contact with the fixing member and the case where the sensor is spaced apart from the fixing member. That is, the temperature sensor may be a contact type or a noncontact type.

In the image forming apparatus of the present one embodiment, the difference between the maximum temperature and the minimum temperature can be obtained simply and accurately.

In the image forming apparatus of one embodiment, the temperature distribution obtaining section obtains by simulation a temperature distribution of the fixing member in the widthwise direction of the sheet.

In the image forming apparatus of the present one embodiment, the parts cost can be reduced by reducing the number of temperature sensors.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

Figure 1:
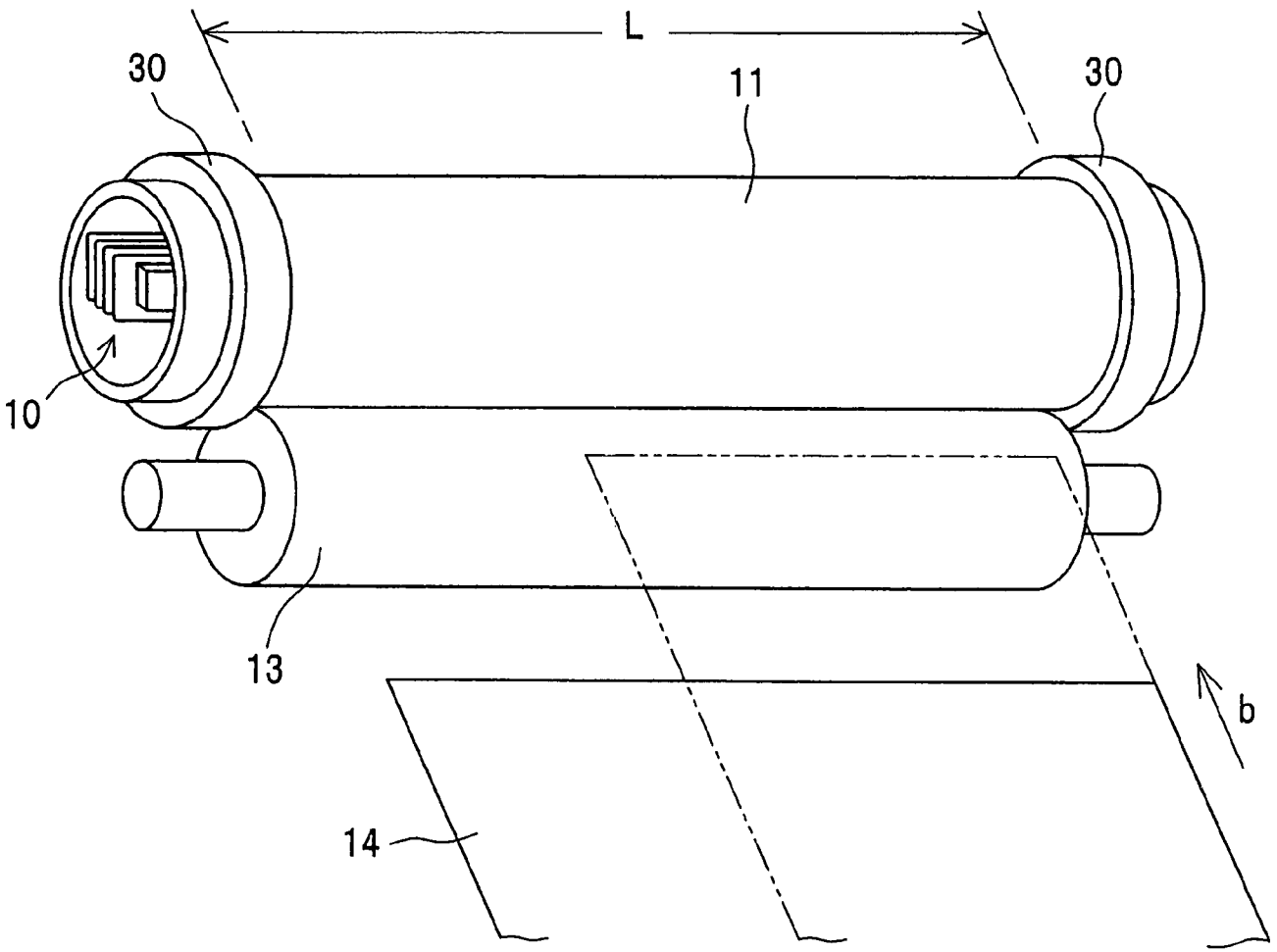
FIG. 1 is a view showing the constituent elements of an electromagnetic induction heating type fixing device according to one embodiment of the present invention, viewed obliquely.

The present invention will be described in detail below by the embodiments shown in the drawings.

Figure 2:
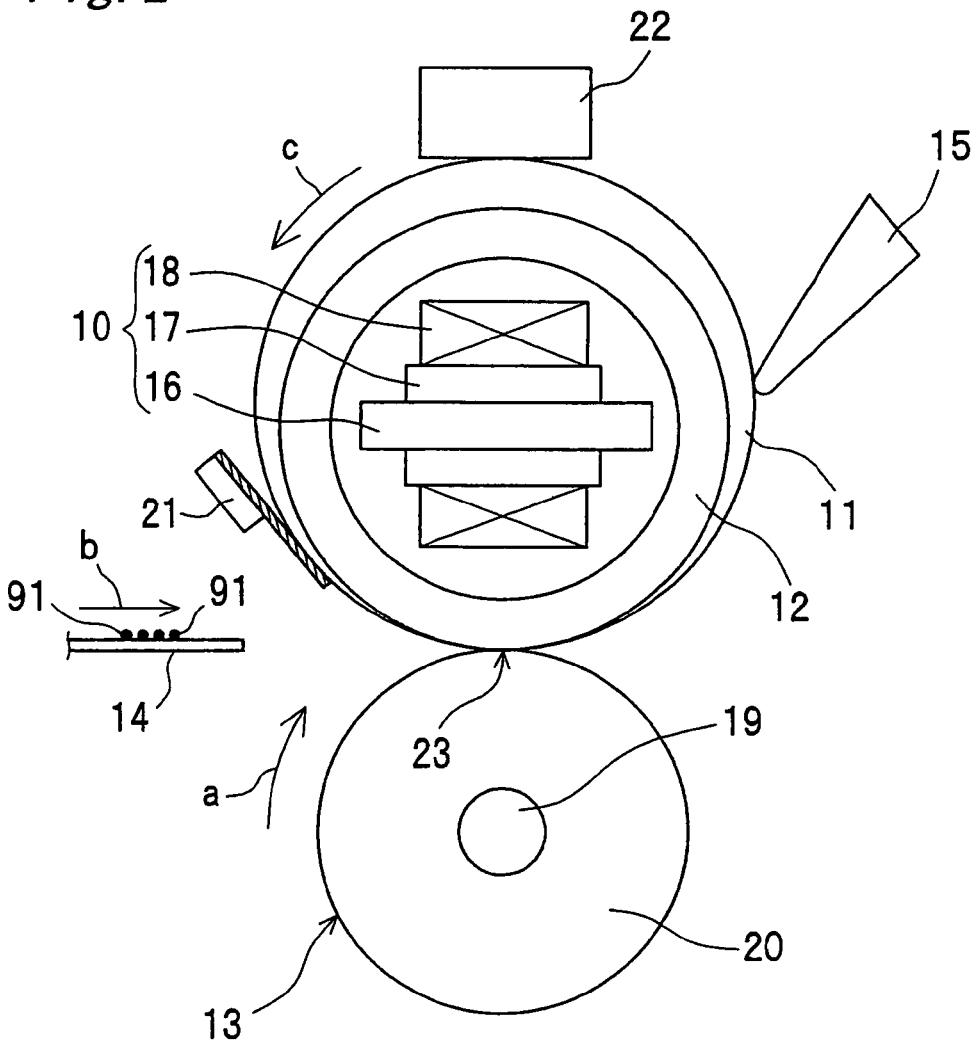
FIG. 2 is a view showing the cross section of the constituent elements of the fixing device.

FIG. 1 shows constituent elements of an electromagnetic induction heating type fixing device according to one embodiment of the present invention, viewed obliquely. FIG. 2 shows a cross section of the constituent elements of the fixing device. The fixing device constitutes part of an image forming apparatus and serves to fix the unfixed toner image 91 that has been adhered to a sheet-shaped paper 14 as a recording medium to be conveyed by melting the image by heating on the sheet 14.

As shown in FIG. 1, the fixing device has an elongate cylindrical metal sleeve 11 as a fixing member and a cylindrical pressure roller 13 brought in pressure contact with the metal sleeve 11. A sheet 14, which has a variety of sizes as indicated by the solid lines and the two-dot chain lines in FIG. 1, is fed into a nip portion (indicated by reference numeral 23 in FIG. 2) constructed of the metal sleeve 11 and the pressure roller 13 as indicated by arrow "b". It is noted that the effective axial length L in the axial direction of the metal sleeve 11 is defined by deflection stopping members 30, 30 provided projecting annularly at both ends in the axial direction of the metal sleeve 11. In the following description, the axial dimension of the metal sleeve 11 is assumed to be L. In this example, the axial dimension L of the metal sleeve 11 approximately coincide with the dimension of the short side (297 mm) of a sheet of A3 size, which is the predetermined largest size. It is noted that the sheets of sizes provided by JIS (Japanese Industrial Standards) are used in the present embodiment.

Figure 3:
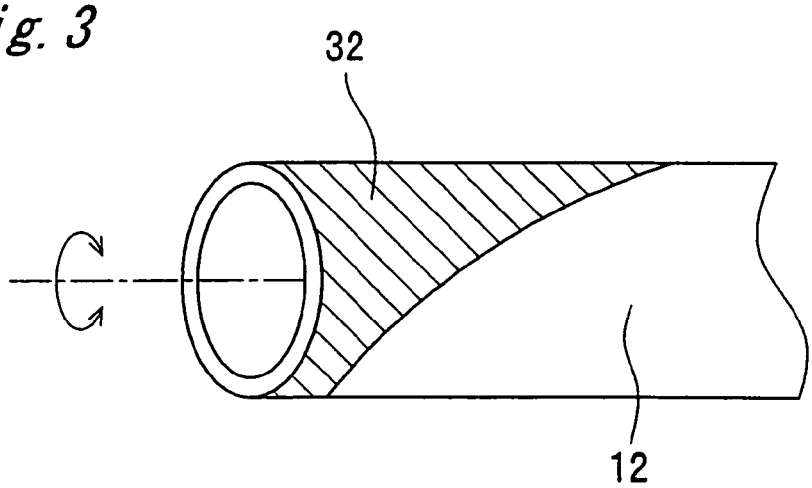
FIG. 3 is a view showing a state in which a magnetic flux shield portion is provided on the outer peripheral surface of a holder of the fixing device.

As shown in FIG. 2, the metal sleeve 11 is provided around a cylindrical holder 12 that extends along the axial direction of the metal sleeve 11 and held between the holder 12 and the pressure roller 13. The holder 12 is generally constructed of a cylindrical support member made of a heat-resistant electrically insulative engineering plastic, which is a nonmagnetic material, and a magnetic flux shield portion 32 (constructed of a thin copper foil or the like, see FIG. 3) integrally formed with its outer peripheral surface. The holder 12 is rotated around the central axis of the holder for magnetic flux regulation at need (described later). The metal sleeve 11 is brought in sliding contact with the outer peripheral surface of the holder 12 and made rotatable around the holder 12. The pressure roller 13 is provided rotatably in the direction of arrow "a" in FIG. 2, and the metal sleeve 11 is driven to rotate in the direction of arrow "c" in accordance with the rotation of the pressure roller 13.

Around the metal sleeve 11 are provided a separation claw 15 that is made of a heat-resistant electrically insulative engineering plastic and has a tip end portion brought in contact with the outer peripheral surface of the metal sleeve 11, a temperature sensor 21 that detects the temperature of the metal sleeve 11, and a thermostat 22 that serves as a safety mechanism when the temperature abnormal rises.

Figure 5:
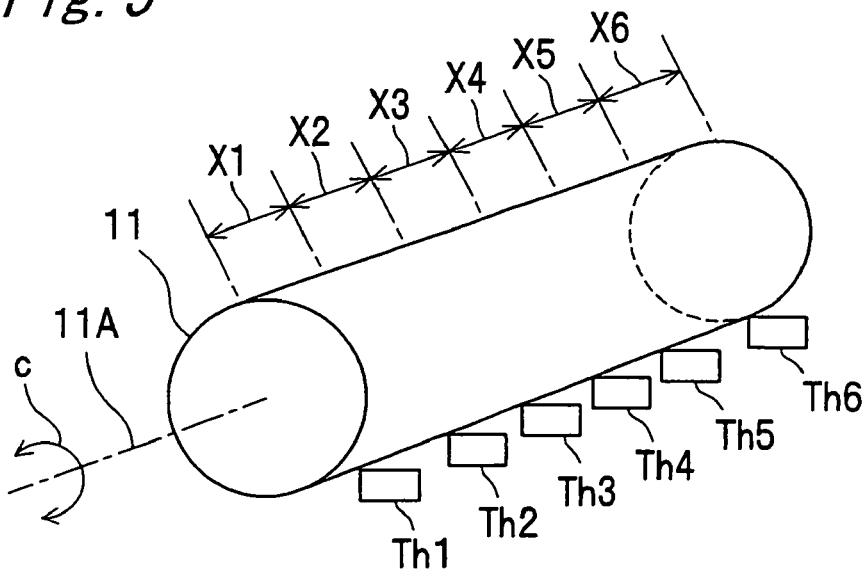
FIG. 5 is a view showing a metal sleeve and thermistors of the fixing device.

As shown in FIG. 5 in the present example, the temperature sensor 21 is put in pressure contact with the surface of the metallic sleeve 11 so as to face an induction coil 18 with interposition of the metallic sleeve 11. The temperature sensor 21 is constructed of a total of six thermistors Th1, Th2, . . . , Th6 provided for blocks X1, X2, . . . , X6, respectively, which are obtained by equally dividing the metal sleeve 11 into six parts in the direction of the central axis 11A of the metal sleeve 11. While detecting the temperature of the metal sleeve 11 by the thermistors Th1, Th2, . . . , Th6, the power supply to the induction coil 18 is controlled so that the temperature of the metal sleeve 11 becomes an optimum temperature. The thermistors Th1, Th2, . . . , Th6 constitute a temperature distribution obtaining section.

The thermostat 22 shown in FIG. 2 is put in contact with the surface of the metal sleeve 11. The thermostat 22 cuts off the power supply to the induction coil 18 by opening its contact when the temperature becomes a preset temperature to prevent the metal sleeve 11 from being raised to a temperature higher than the predetermined temperature.

A coil assembly 10 is placed in the holder 12 and retained by the holder 12. The coil assembly 10 generates a high frequency magnetic field upon receiving an alternating current by a high frequency power source section (not shown) and generates Joule heat by inducing an induction current (eddy current) in the metal sleeve 11.

The metal sleeve 11 is a thin hollow metal conductor having flexibility and has a conductive layer formed of a conductive magnetic material of, for example, nickel, iron, stainless steel SUS430 or the like. Then, a heat-resistant mold release layer is formed of fluororesin coating on the outer peripheral surface of the metal sleeve 11. The metal layer of the metal sleeve 11 has a thickness of 20 μm to 60 μm.

The coil assembly 10 has a core 16 (corresponding to the core member) made of a magnetic material, a bobbin 17 formed having a through hole in which the core 16 is inserted, and the induction coil 18 that is formed by winding a copper wire around the bobbin 17 and induces an induction current in the metal sleeve 11 to heat the sleeve. The core 16 is preferably made of a material of a large magnetic permeability and a small self-loss and appropriately made of, for example, ferrite, Permalloy, sendust or the like. The bobbin 17 is made of a heat-resistant electrically insulative engineering plastic and functions as an insulating portion that provides insulation between the core 16 and the induction coil 18. The lengthwise dimension (total length) of the coil assembly 10 substantially coincides with the axial dimension L of the metal sleeve 11, and the coil assembly 10 is housed in the holder 12 formed separately from the bobbin 17 so as not to be exposed to the outside. In the sectional view of FIG. 2, the position of the coil assembly 10 is biased from the central axis of the metal sleeve 11 toward the nip portion 23 side. With this arrangement, the coil assembly 10 generates heat mainly in the vicinity of the nip portion 23 of the metal sleeve 11.

The pressure roller 13 is constructed of an axial core 19 and a silicone rubber layer 20 that is a surface release type heat-resistant rubber layer formed around the axial core 19.

The sheet 14 on which the unfixed toner image 91 has been transferred is conveyed from the direction indicated by arrow "b" in FIG. 2 and fed into the nip portion 23 that holds the sheet 14. The sheet 14 is conveyed through the nip portion 23 while receiving heat of the heated metal sleeve 11 and a pressure applied from the pressure roller 13. As a result, the unfixed toner 91 is fixed, and a fixed toner image is formed on the sheet 14. The sheet 14, which has passed through the nip portion 23, is separated from the metal sleeve 11 by the separation claw 15 and conveyed in the rightward direction in FIG. 2. The sheet 14 is conveyed by a sheet ejection roller (not shown) and discharged onto a copy receiving tray.

Figure 4:
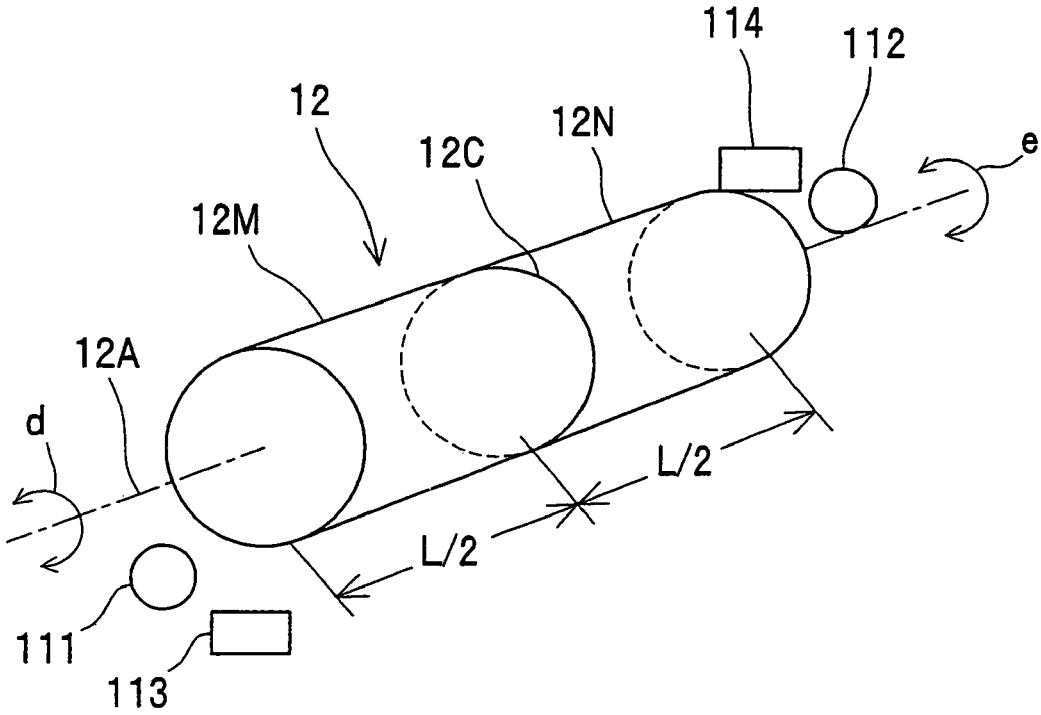
FIG. 4 is a view showing the construction of the holder of the fixing device.

FIG. 4 schematically shows the holder 12 viewed obliquely with the metal sleeve 11 removed. In this example, the holder 12 is divided in the direction of the central axis 12A into two parts of a holder 12M that serves as a first support member and a holder 12N that serves as a second support member via a boundary plane 12C. As a result, each of the holder 12M and the holder 12N has an axial dimension of L/2. By thus dividing the holder, the variations of the regions in which the generation of heat can be restricted by the magnetic flux shield portion 32 described later are increased.

A first motor 111 and a second motor 112, which serve as displacement mechanisms, are placed in the vicinity of the end portions of the holder 12M and the holder 12N oppositely from the boundary plane 12C. The first motor 111 and the second motor 112 are each constructed of a stepping motor, which is rotatable forwardly and reversely. With this arrangement, the holders 12M, 12N can independently be rotated around the central axis 12A (indicated by arrows "d" and "e"). By virtue of the first motor 111 and the second motor 112 that are each arranged rotatable forwardly and reversely, time required for displacing the holder 12M and the holder 12N to respective target angular positions can be shortened. It is noted that the displacement mechanism may be constructed of one motor, a clutch and so on. Since the arrow "e" is similar to the arrow "d", the following description is made by using the arrow "d".

Moreover, a first circumferential position sensor 113 and a second circumferential position sensor 114 for detecting displacements (angular positions) in the circumferential direction "d" of the holder 12M and the is holder 12N are provided in the vicinity of the end portions of the holder 12M and the holder 12N.

Figure 6:
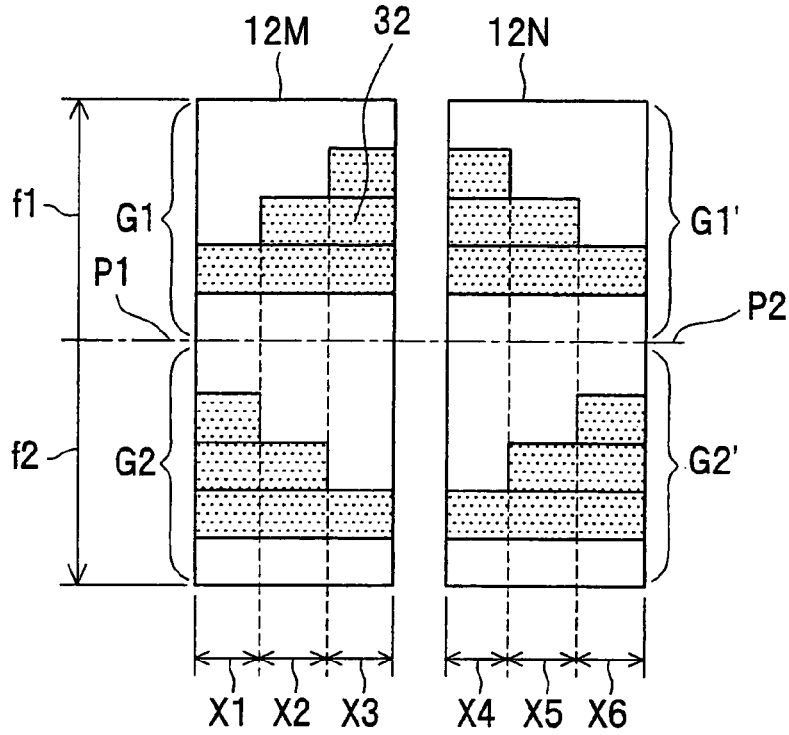
FIG. 6 is a view showing one example of the pattern of the magnetic flux shield portion provided on the outer peripheral surface of each holder, shown in a state in which each holder is developed in a plane.

FIG. 6 shows one example of the pattern of the magnetic flux shield portion 32 provided on the outer peripheral surface of the holder 12M and the holder 12N in a state in which the holders are each developed in a plane. In this example, the pattern on the holder 12M includes a first pattern portion G1 whose dimension in the direction of the central axis (corresponding to the transverse direction in FIG. 6, and so forth) is gradually decreased from the total length L/2 (see FIG. 4) and deviated toward the holder 12N side as located farther away from a reference position P1 on the holder 12M toward one side f1 in the circumferential direction, and a second pattern portion G2 whose dimension in the direction of the central axis is gradually increased toward the holder 12N side from zero to the total length L/2 as located farther away from the reference position P1 toward the other side f2 in the circumferential direction. Then, the first and second patterns G1, G2 on the holder 12M have the dimensions in the direction of the central axis increased or decreased step-by-step in units of a dimension (i.e., L/6) corresponding to the blocks X1, X2, X3 of the metal sleeve 11 as located farther away from the reference position P1 in the circumferential direction.

Patterns G1' and G2' on the holder 12N are formed symmetrically to the patterns G1, G2 (transversely symmetrical in FIG. 6) on the holder 12M with respect to the boundary plane 12C (see FIG. 4). That is, the pattern on the holder 12N includes a first pattern portion G1' whose dimension in the direction of the central axis is gradually decreased from the total length L/2 (see FIG. 4) and deviated toward the holder 12M side as located farther away from the reference position P2 on the holder 12N toward the one side f1 in the circumferential direction, and a second pattern portion G2' whose dimension in the direction of the central axis is gradually increased to the holder 12N side from zero to the total length L/2 as located farther away from the reference position P2 toward the other side f2 in the circumferential direction. Then, the first and second patterns G1', G2' on the holder 12N have the dimensions in the direction of the central axis increased or decreased step-by-step in units a dimension (i.e., L/6) corresponding to the blocks X4, X5, X6 of the metal sleeve 11 as located farther away from the reference position P2 in the circumferential direction.

As described above, the dimensions in the direction of the central axis of the first and second patterns G1, G2 on the holder 12M and the first and second patterns G1', G2' on the holder 12N are increased or decreased step-by-step in blocks. Therefore, when the generation of heat is restricted in blocks on the metal sleeve 11 described later, it is proper to rotate the angular positions of the holder 12M and the holder 12N every angle of increase or decrease step-by-step. Therefore, it becomes easy to control the angular positions of the holder 12M and the holder 12N.

Figure 8:
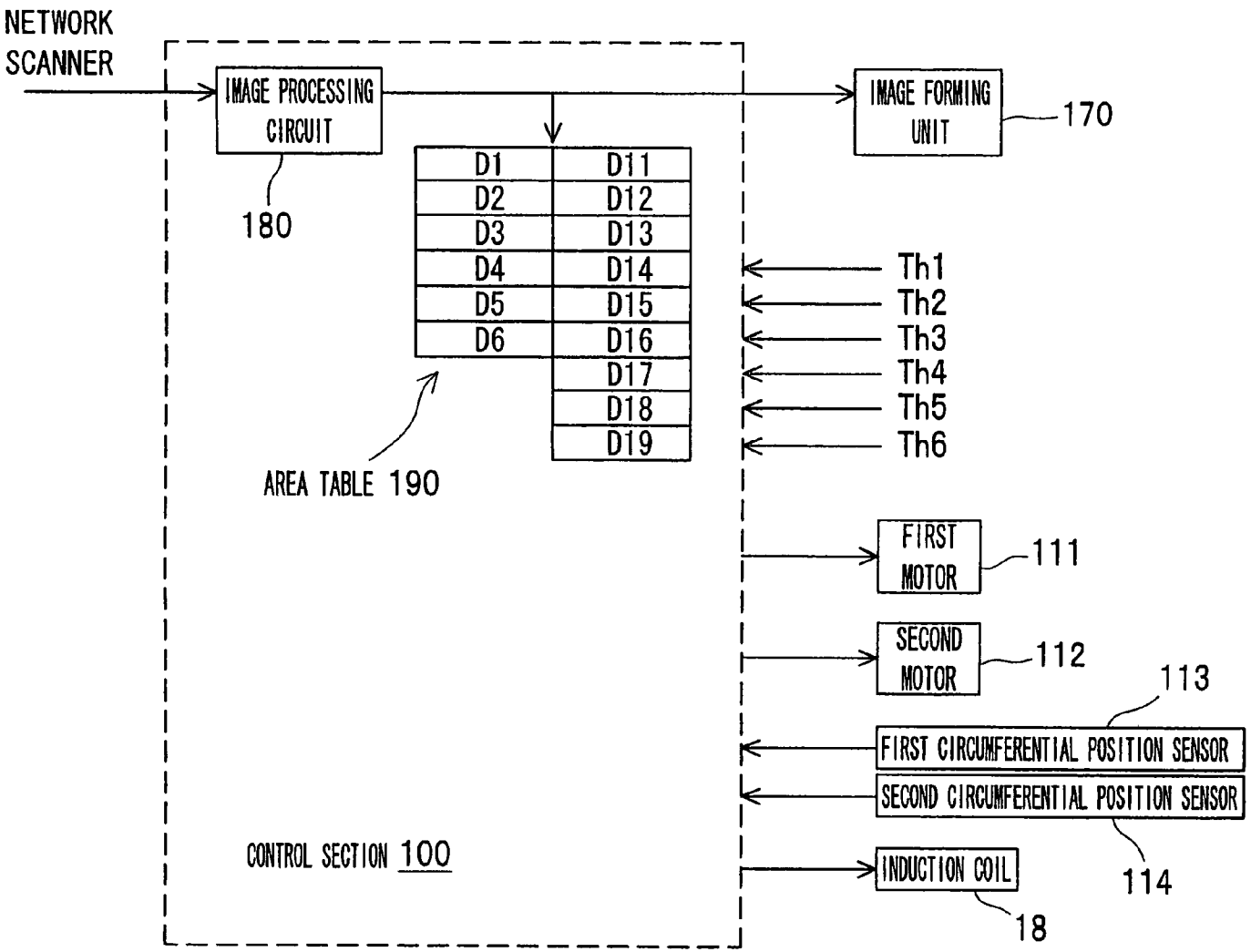
FIG. 8 is a diagram showing the block construction of a control system of an image forming apparatus of one embodiment that includes the fixing device.

FIG. 8 shows the block construction of the image forming apparatus including the fixing device. The image forming apparatus has a control section 100 including a central processing unit (CPU) and an image forming unit 170 as an image forming section. The control section 100 includes an image processing circuit 180 for processing an image signal that is taken in from a network or read by an accessory scanner, and an area table 190 that serves as a memory section. The image processing circuit 180 converts the inputted image signal into a laser signal to make a laser diode section of the image forming unit 170 expose the photoconductor surface to light.

The image forming unit 170 includes a photoconductor, a laser diode section for forming a latent image by exposing the photoconductor surface to light, a developing section for developing the latent image on the photoconductor surface by making toner adhere, and a transfer section for transferring the toner image on the photoconductor surface onto a paper as a sheet, although every member of which is not shown. Then, the toner image is formed on the paper as the sheet by executing the well-known electrophotography process.

The control section 100 operates as first and second image region detecting sections for detecting the image region on the sheet occupied by the image to be fixed. In concrete, the section operates as a counting section to detect the density of toner transferred to the area, area-by-area on the sheet. In detail, the sheet fed into the nip portion 23 is divided into a plurality of areas in the widthwise direction of the sheet. In this example, a length (297 mm) corresponding the dimension L in the axial direction of the metal sleeve 11 is equally comparted into six areas (corresponding one by one to the blocks X1, X2, . . . , X6 on the metal sleeve 11 already described). Then, the on- and off-states of the laser signal of each comparted area is counted. The count values (dot counts) of the areas in the widthwise direction of the sheet are stored as data D1, D2, . . . , D6 representing the amounts of image of the areas into the area table 190. Concomitantly, the sheet fed into the nip portion 23 is also comparted into a plurality of areas in the conveyance direction of the sheet. In this example, a length (420 mm) corresponding to the long side of the sheet of A3 size, which is the maximum size is comparted into nine areas. Then, the on- and off-states of the laser signal of each comparted area is counted. The count values (dot counts) of the areas in the conveyance direction of the sheet are stored as data D11, D12, . . . , D19 representing the amounts of image in the areas into the area table 190.

When the areas where the dot counting is performed correspond one by one to the blocks on the metal sleeve 11 as described in this example, it is easily determined block-by-block whether or not the block belongs to the image region as described later. Therefore, the control of specifying the region in which the control section 100 should restrict the generation of heat becomes easy.

The dot counting, which needs to express the density of the toner transferred to the sheet, may be achieved by counting the number of on- and off-states when the laser beam is applied to the photoconductor on the basis of the image data or measuring the number (amount) of on-states by discharge duration of on-state data stored in a capacitor or counting the number of on-states by software when image processing is carried out. Since these methods are already well known, no description is provided therefor. Moreover, strictly speaking, the equation of: amount of exposure of photoconductor to laser light=amount of toner development=amount of transfer does not hold. However, means for counting the amount of transfer itself is hard to achieve, and it is acceptable to perform the counting by using a value obtained through conversion from the amount of exposure in consideration of the development efficiency as the amount of development and using a value obtained through conversion from the amount of exposure in consideration of the transfer efficiency as the amount of transfer.

Moreover, a temperature signal representing the temperature of the metal sleeve 11 is inputted from the thermistors Th1, Th2, . . . , Th6 to the control section 100. On the basis of the temperature signal, for example, a temperature signal representing the temperature of the blocks corresponding to the region in which the sheet passes on the metal sleeve 11, the control section 100 outputs a signal for controlling the on- and off-states of the power supply (by the high frequency power source section) to the induction coil 18.

Moreover, an angular position signal representing the displacement (angular position) in the circumferential direction "d" of the holder 12M and the holder 12N is inputted from the first circumferential position sensor 113 and the second circumferential position sensor 114 to the control section 100. The control section 100 moves and retains the holder 12M and the holder 12N into the respective desired angular positions by outputting a control signal to the first motor 111 and the second motor 112 while referring to the angular position signal.

Figure 9A:
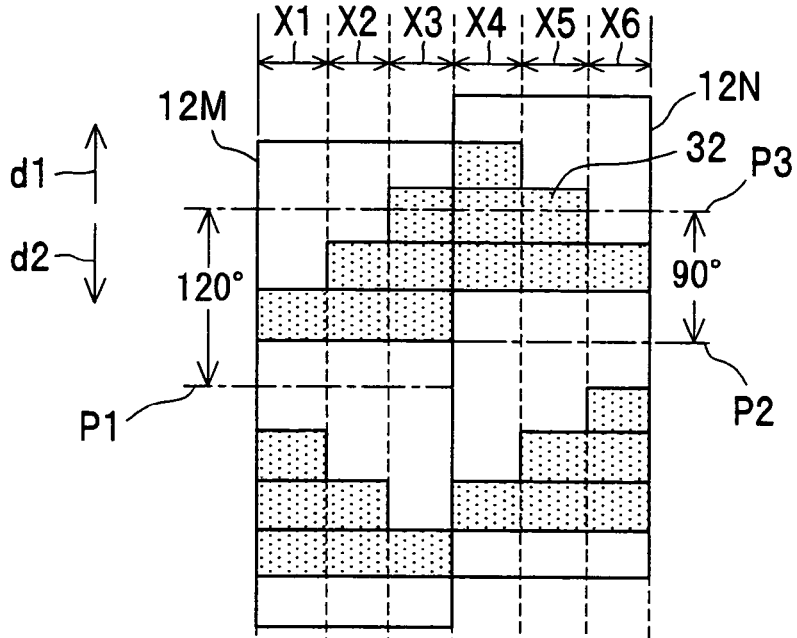
FIG. 9A is a view showing one example of the angular position taken by each holder having the pattern of the magnetic flux shield portion shown in FIG. 6.
Figure 9B:
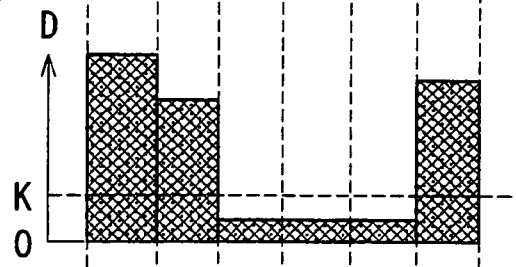
FIG. 9B is a view showing a histogram of the amount of toner in the widthwise direction of the sheet when the angular position shown in FIG. 9A is taken.
Figure 9C:
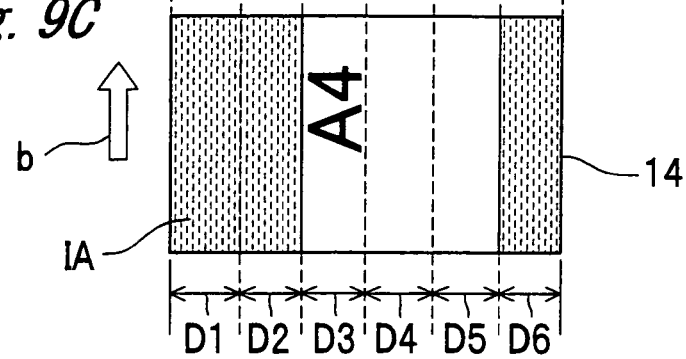
FIG. 9C is a view showing the state of the sheet that has an image region in which the histogram of the amount of toner shown in FIG. 9B is obtained.

FIGS. 9A through 9C show a relation between the dot count of each area in the widthwise direction of the sheet 14 and the angular positions where the holder 12M and the holder 12N should be placed in accordance with the dot count in the case where the sheet 14 of A4 size is fed in landscape orientation into the nip portion (in the case of "A4 landscape" sheet feed). FIG. 9C shows that, when the sheet 14 is viewed upright, it can be understood that the region of an upper portion of the sheet (about ⅓ of the longitudinal dimension in this example) and the region like a lower footer are image regions IA onto which the toner images (indicated by dotted lines) actually adhere. In this case, the data D1, D2, . . . , D6 in the area table 190 after detection of the amount of image are expressed by a histogram D as shown in FIG. 9B. In this example, the data D1, D2, D6 have comparatively large values, and the data D3, D4, D5 have comparatively small values.

An example of the control of heating only the image region on the sheet by detecting the image region in the widthwise direction of the sheet is described with reference to FIGS. 9A through 9C.

The control section 100 operates as a determining section to determine whether or not the data representing the amount of image of each area exceeds a prescribed threshold value K and determine that the area whose data exceeds the threshold value K belongs to the image region IA. In this example, it is determined that the areas corresponding to the blocks X1, X2, X6 on the metal sleeve 11 belong to the image region IA and the areas corresponding to the remaining blocks X3, X4, X5 belong to no image region. Therefore, it can be understood that the blocks X1, X2, X6 on the metal sleeve 11 need to accurately have the target temperature by heating and the remaining blocks X3, X4, X5 are allowed to undergo restricted heating in the fixing operation.

In the above case, the control section 100 operates as a first control section to heat only the blocks X1, X2, X6 on the metal sleeve 11 and restrict the generation of heat in the remaining blocks X3, X4, X5. In concrete, the angular positions of the holder 12M and the holder 12N are controlled by outputting a control signal to the first motor 111 and the second motor 112 as shown in FIG. 9A. In this example, the holder 12M is retained in an angular position rotated by 120° in a reverse rotational direction d2, and the holder 12N is retained in an angular position rotated by 90° in the reverse rotational direction d2 from a home position P3 (position located closest to the nip portion 23). By this operation, the magnetic fluxes directed from the induction coil 18 toward the blocks X3, X4, X5 on the metal sleeve 11 are interrupted by the patterns that form the magnetic flux shield portions 32 of the holder 12M and the holder 12N. Therefore, only the blocks X1, X2, X6 on the metal sleeve 11 are heated, and the generation of heat in the remaining blocks X3, X4, X5 is restricted. As a result, only the image region IA can be heated in the widthwise direction of the sheet 14. Therefore, energy conservation can be achieved.

Figure 10A:
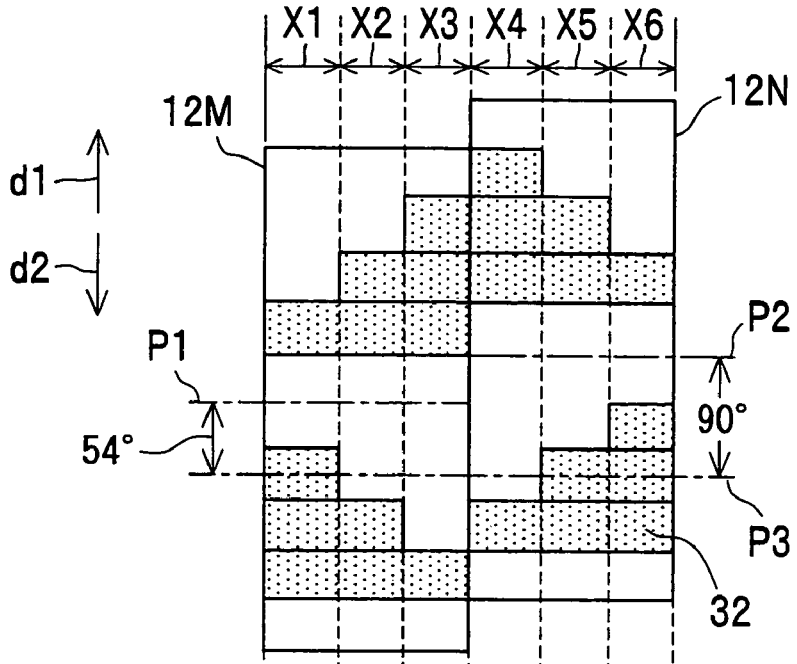
FIG. 10A is a view showing another example of the angular position taken by each holder having the pattern of the magnetic flux shield portion shown in FIG. 6.
Figure 10B:
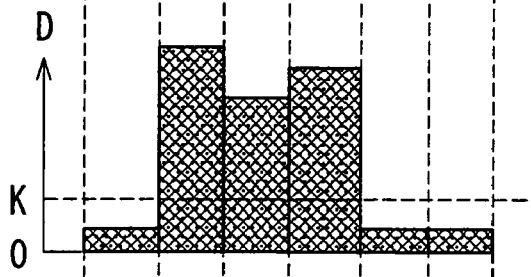
FIG. 10B is a view showing a histogram of the amount of toner in the widthwise direction of the sheet when the angular position shown in FIG. 10A is taken.
Figure 10C:
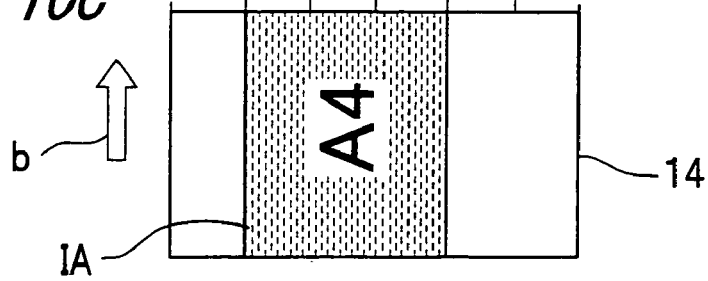
FIG. 10C is a view showing the state of the sheet that has an image region in which the histogram of the amount of toner shown in FIG. 10B is obtained.

FIGS. 10A through 10C show an example in which only the position of the image region IA on the sheet 14 differs from that of the example of FIGS. 9A through 9C. As is apparent from FIGS. 10C and 10B, the areas corresponding to the block X2, X3, X4 on the metal sleeve 11 belong to the image region IA, and the areas corresponding to the remaining blocks X1, X5, X6 are not image regions.

In the above case, the control section 100 operates as the first control section to heat only the blocks X2, X3, X4 on the metal sleeve 11 and restrict the generation of heat in the remaining blocks X1, X5, X6 on the metal sleeve 11. In concrete, the angular positions of the holder 12M and the holder 12N are controlled as shown in FIG. 10A by outputting a control signal to the first motor 111 and the second motor 112. In this example, the holder 12M is retained in an angular position rotated by 54° in the forward rotational direction d1, and the holder 12N is retained in an angular position rotated by 90° in the forward rotational direction d1 from the home position P3 (position located closest to the nip portion 23). By this operation, the magnetic fluxes directed from the induction coil 18 toward the blocks X1, X5, X6 on the metal sleeve 11 is interrupted by the patterns that form the magnetic flux shield portions 32 of the holder 12M and the holder 12N. Therefore, only the blocks X2, X3, X4 on the metal sleeve 11 are heated, and the generation of heat in the remaining blocks X1, X5, X6 is restricted. As a result, only the image region IA can be heated in the widthwise direction of the sheet 14. Therefore, energy conservation can be achieved.

In the construction in which the magnetic flux from the induction coil 18 are interrupted by the magnetic flux shield portion 32, the metal sleeve 11 is heated by the magnetic fluxes diffracted around the magnetic flux shield portion 32 at the boundary in the vicinity of the pattern of the magnetic flux shield portion 32. Therefore, when the blocks on the metal sleeve 11 are fragmented into a greater number of blocks, a situation in which the blocks of the metal sleeve 11 shielded by the magnetic flux shield portion 32 are also disadvantageously heated by the magnetic fluxes diffracted around the blocks occurs. In such a case, it is desirable to perform adjustment by, for example, setting large the pattern area of the magnetic flux shield portion 32.

Figure 7:
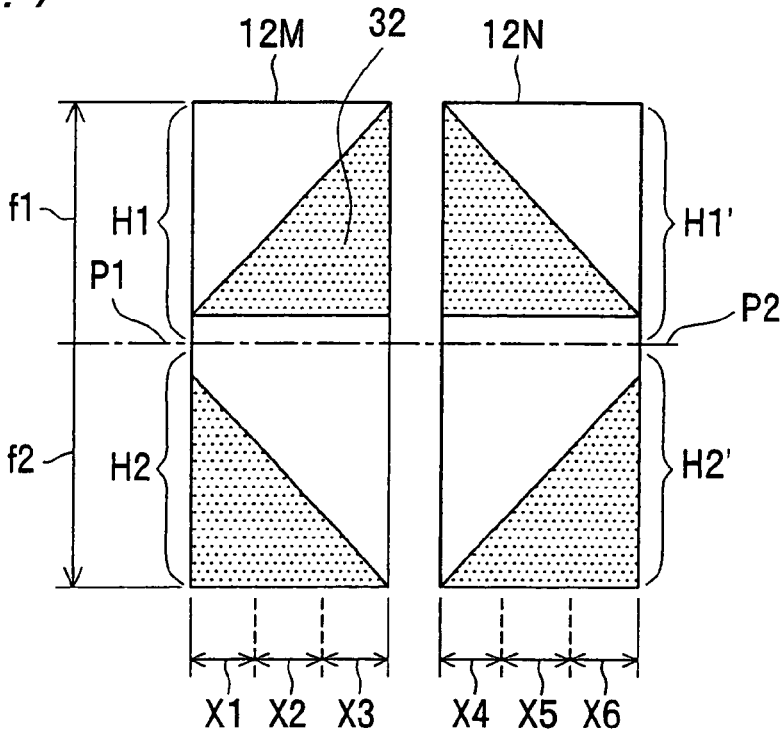
FIG. 7 is a view showing another example of the pattern of the magnetic flux shield portion provided on the outer peripheral surface of each holder, shown in a state in which each holder is developed in a plane.

FIG. 7 shows another example of the pattern of the magnetic flux shield portion 32 provided on the outer peripheral surfaces of the holder 12M and the holder 12N in a state in which the holders are each developed in a plane. In this example, the pattern on the holder 12M includes a first pattern portion H1 whose dimension in the direction of the central axis (corresponding to the transverse direction in FIG. 7, and so forth) is gradually decreased from the total length L/2 (see FIG. 4) and deviated toward the holder 12N side as located farther away from the reference position P1 on the holder 12M toward one side f1 in the circumferential direction, and a second pattern portion H2 whose dimension in the direction of the central axis is gradually increased from zero to the total length L/2 toward the holder 12N side as located farther away from the reference position P1 toward the other side f2 in the circumferential direction. Then, the first and second patterns H1, H2 on the holder 12M have the dimensions in the direction of the central axis linearly increased or decreased as located farther away from the reference position P1 in the circumferential direction.

Patterns H1' and H2' on the holder 12N are formed symmetrically to the patterns H1, H2 (transversely symmetrical in FIG. 7) on the holder 12M with respect to the boundary plane 12C (see FIG. 4). That is, the pattern on the holder 12N includes a first pattern portion H1' whose dimension in the direction of the central axis is gradually decreased from the total length L/2 (see FIG. 4) and deviated toward the holder 12M side as located farther away from the reference position P2 on the holder 12N toward the one side f1 in the circumferential direction, and a second pattern portion H2' whose dimension in the direction of the central axis is gradually increased from zero to the total length L/2 toward the holder 12M side as located farther away from the reference position P2 toward the other side f2 in the circumferential direction. Then, the first and second patterns H1', H2' on the holder 12N have the dimensions in the direction of the central axis linearly increased or decreased as located farther away from the reference position P2 in the circumferential direction.

In short, the pattern of the magnetic flux shield portion 32 of FIG. 7 differs from the patterns of FIG. 6 in that the dimension in the direction of the central axis is linearly increased or decreased as located farther away from the reference position P2 in the circumferential direction. Therefore, the region, in which the generation of heat can be restricted in the widthwise direction of the sheet, of the metal sleeve 11 can be set continuously variably.

Figure 11A:
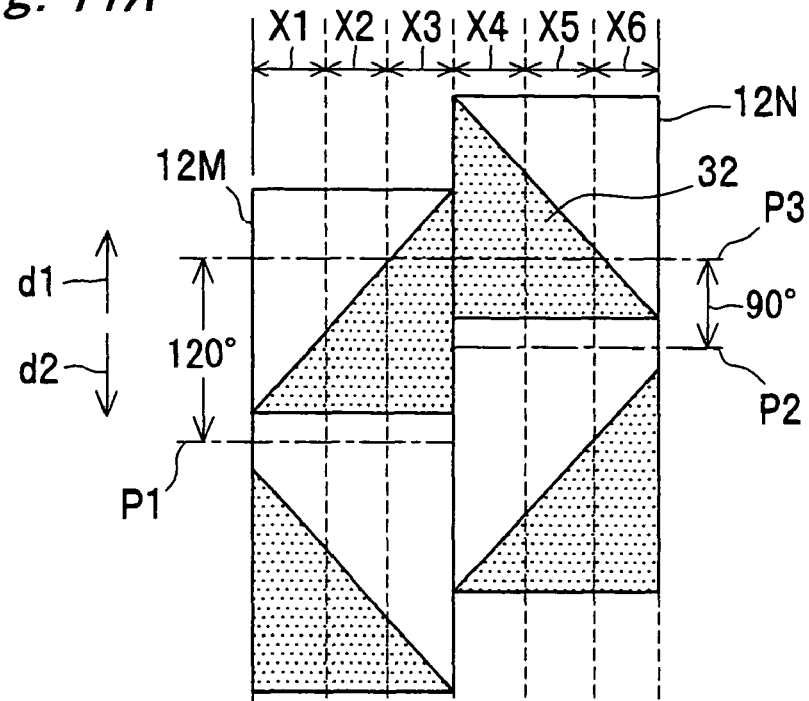
FIG. 11A is a view showing one example of the angular position taken by each holder having the pattern of the magnetic flux shield portion shown in FIG. 7.
Figure 11B:
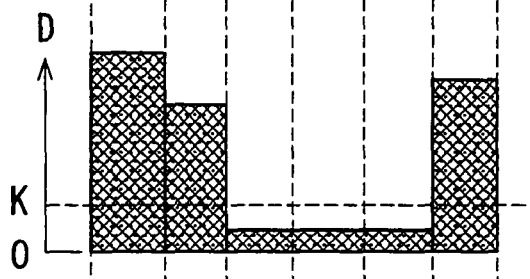
FIG. 11B is a view showing a histogram of the amount of toner in the widthwise direction of the sheet when the angular position shown in FIG. 11A is taken.
Figure 11C:
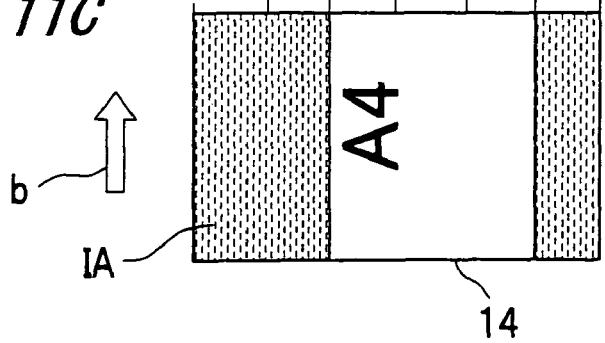
FIG. 11C is a view showing the state of the sheet that has an image region in which the histogram of the amount of toner shown in FIG. 11B is obtained.

FIGS. 11A through 11C show a relation between the dot count of each area in the widthwise direction of the sheet 14 and the angular positions where the holder 12M and the holder 12N should be placed in accordance with the dot count in the case where the sheet 14 of A4 size is fed in landscape orientation into the nip portion (in the case of "A4 landscape" sheet feed) in correspondence with FIGS. 9A through 9C. In this case, the way of control by the control section 100 is similar to that described with reference to FIGS. 9A through 9C. Also, in this case, only the image region IA can be heated in the widthwise direction of the sheet 14. Therefore, energy conservation can be achieved.

Figure 12A:
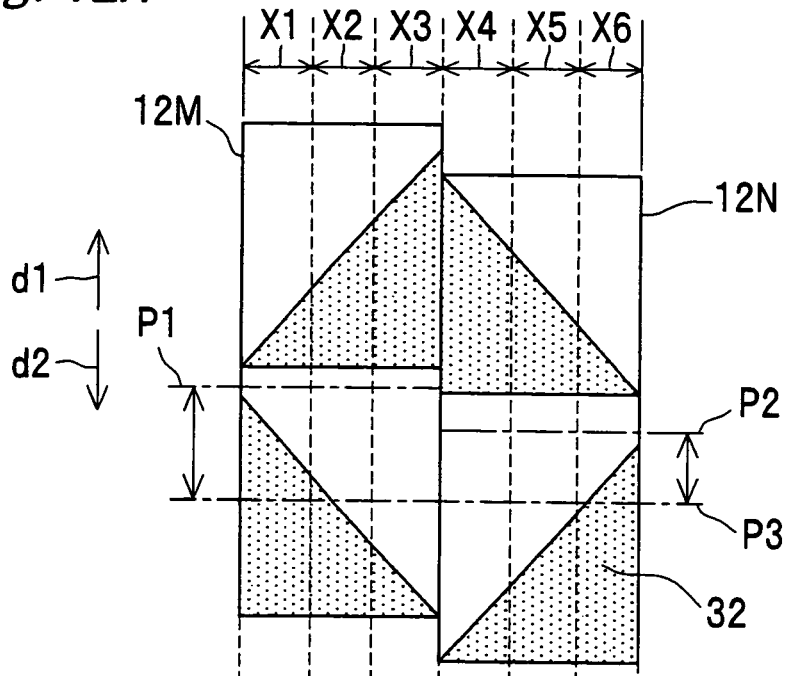
FIG. 12A is a view showing another example of the angular position taken by each holder having the pattern of the magnetic flux shield portion shown in FIG. 6.
Figure 12B:
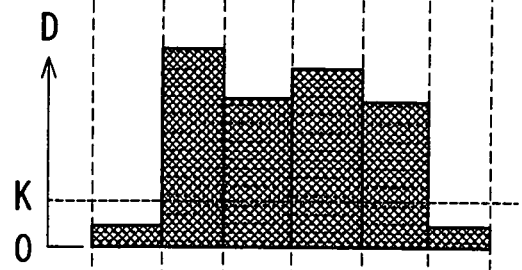
FIG. 12B is a view showing a histogram of the amount of toner in the widthwise direction of the sheet when the angular position shown in FIG. 12A is taken.
Figure 12C:
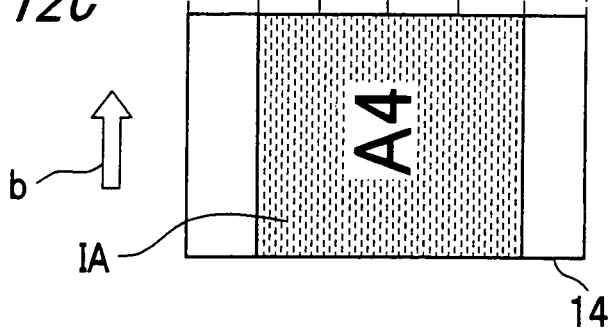
FIG. 12C is a view showing the state of the sheet that has an image region in which the histogram of the amount of toner shown in FIG. 12B is obtained.

FIGS. 12A through 12C show a relation between the dot count of each area in the widthwise direction of the sheet 14 and the angular positions where the holder 12M and the holder 12N should be placed in accordance with the dot count in the case where the sheet 14 of A4 size is fed in landscape orientation into the nip portion (in the case of "A4 landscape" sheet feed) in correspondence with FIGS. 10A through 10C. In this case, the way of control by the control section 100 is similar to that described with reference to FIGS. 10A through 10C. However, in this example, the block X5 also belongs to the image region IA in addition to the blocks X2, X3, X4 on the metal sleeve 11. Therefore, the control section 100 heats the blocks X2, X3, X4, X5 on the metal sleeve 11 and restricts the generation of heat in the remaining blocks X1, X6. Also, in this case, only the image region IA can be heated in the widthwise direction of the sheet 14. Therefore, energy conservation can be achieved.

Figure 13A:
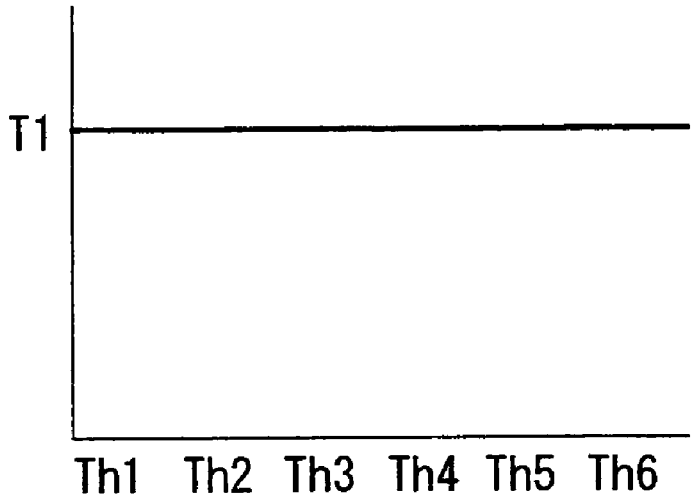
FIG. 13A is a graph showing a uniform temperature distribution when the metal sleeve is controlled to a target temperature T1.

FIG. 13A shows a uniform temperature distribution detected by the thermistors Th1, Th2, . . . , Th6 (see FIG. 5) when the metal sleeve 11 is controlled to the target temperature T1 (setting temperature for fixation) over all the blocks X1, X2, . . . , X6 immediately before the start of the fixing operation.

Figure 13B:
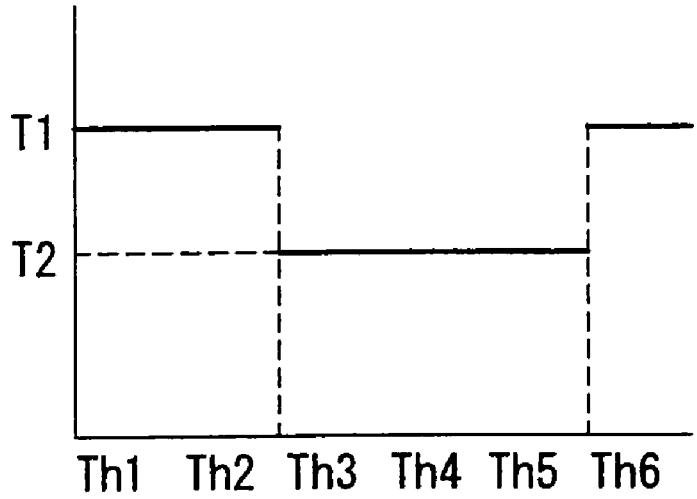
FIG. 13B is a graph showing a temperature distribution when some of the blocks on the metal sleeve are heated and the generation of heat in the remaining blocks is restricted.

However, when the control of heating only the blocks X1, X2, X6 on the metal sleeve 11 and restricting the generation of heat in the remaining blocks X3, X4, X5 is executed as in the example of FIGS. 9A through 9C continuously on, for example, a plurality of sheets, the temperatures Th1, Th2, Th6 of the blocks X1, X2, X6 are maintained at the target temperature T1, whereas the temperatures of the remaining blocks X3, X4, X5 are lowered to the temperature T2 lower than the target temperature T1 as shown in FIG. 13B. In this case, if a temperature difference (T1−T2) is excessively large in the sheet feed region (sheet passing region), through which the sheet should pass, of the metallic sleeve 11, then a trouble of the generation of wrinkles (paper wrinkles) in the sheet after fixation possibly occurs.

Therefore, the control section 100 operates as a third control section to obtain a difference ($T_{MAX}-T_{MIN}$) between a maximum temperature $T_{MAX}$ and a minimum temperature $T_{MIN}$ in the sheet feed region on the metal sleeve 11 by using the temperatures detected by the thermistors Th1, Th2, . . . , Th6. When the difference ($T_{MAX}-T_{MIN}$) exceeds a prescribed threshold value (50° C. in this example), control of permitting the generation of heat in the whole area of the sheet feed region of the metal sleeve 11 (paper wrinkle correction) is executed. By this operation, wrinkles can be prevented from generating in the sheet after fixation. Moreover, since the plurality of thermistors Th1, Th2, . . . , Th6 are arranged along the axial direction of the metal sleeve 11 in this example, the difference ($T_{MAX}-T_{MIN}$) between the maximum temperature $T_{MAX}$ and the minimum temperature $T_{MIN}$ can be obtained simply and accurately.

Figure 14A:
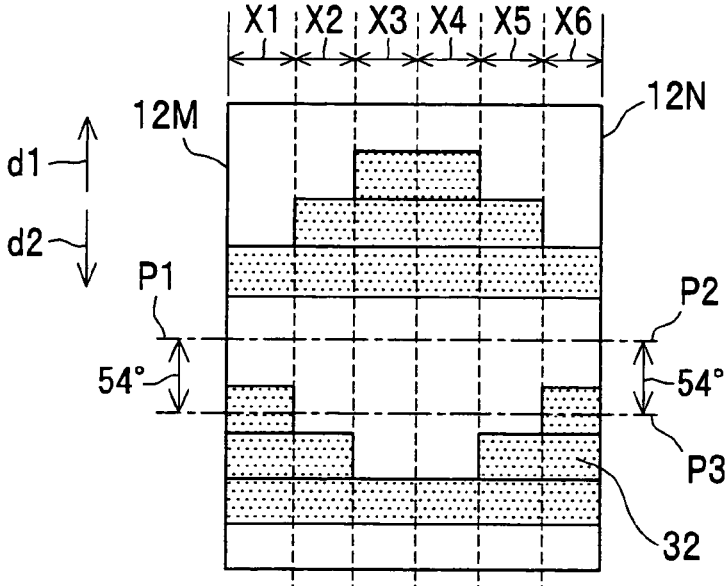
FIG. 14A is a view showing another example of the angular position taken by each holder having the pattern of the magnetic flux shield portion shown in FIG. 6.
Figure 14B:
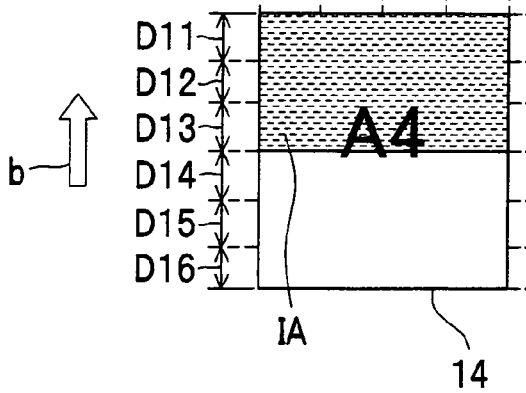
FIG. 14B is a view showing the state of the sheet that has an image region when the angular position shown in FIG. 14A is taken.
Figure 14C:
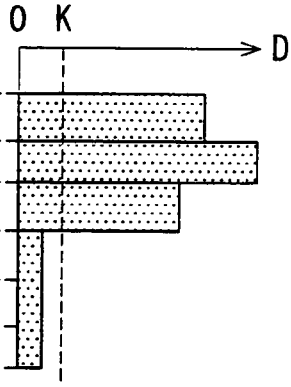
FIG. 14C is a view showing a histogram of the amount of toner in the conveyance direction of the sheet shown in FIG. 14B.

FIGS. 14A through 14C show a relation between the dot count of each area in the conveyance direction of the sheet 14 (indicated by arrow "b") and the angular positions where the holder 12M and the holder 12N should be placed in accordance with the dot count in the case where the sheet 14 of A4 size is fed in portrait orientation into the nip portion (in the case of "A4 portrait" sheet feed). FIG. 14B shows that, when the sheet 14 is viewed upright, it can be understood that the region of the upper half of the sheet is the image region IA to which the toner image (indicated by the dotted lines) actually adheres. The image region IA occupies the whole area in the widthwise direction of the sheet (transverse direction in FIG. 14B). In this case, data D11, D12, . . . , D16 in the area table 190 after detection of the amount of image are expressed by a histogram D as shown in FIG. 14C. In this example, the data D11, D12, D13 have comparatively large values, and the data D14, D15, D16 have comparatively small values. Moreover, with regard to the data D1, D2, . . . , D6 in the area table 190, the data D2, D3, D4, D5 have comparatively large values, and the data D1, D6 have comparatively small values although not shown.

An example of control of heating only the image region on the sheet by detecting the image region in not only the widthwise direction of the sheet but also the conveyance direction of the sheet is described with reference to FIGS. 14A through 14C.

The control section 100 operates as a determining section to determine whether or not the data representing the amount of image of each area exceeds the prescribed threshold value K and determine that such an area in which the data exceeds the prescribed threshold value K belongs to the image region IA. In this example, it is determined that the areas corresponding to the blocks X2, X3, X4, X5 on the metal sleeve 11 belong to the image region IA, and the areas corresponding to the remaining blocks X1, X6 are not the image region in the widthwise direction of the sheet. Therefore, it can be understood that the blocks X2, X3, X4, X5 on the metal sleeve 11 need to accurately have the target temperature by being heated, whereas the generation of heat in the remaining blocks X1, X6 may be restricted in the fixing operation. Moreover, it can be understood that the areas corresponding to the data D11, D12, D13 need to accurately have the target temperature by being heated, whereas the generation of heat in the remaining areas corresponding to the data D14, D15, D16 may be restricted in the conveyance direction of the sheet.

In the above case, the control section 100 operates as the first control section to heat only the blocks X2, X3, X4, X5 on the metal sleeve 11 and restricts the generation of heat in the remaining blocks X1, X6. In concrete, a control signal is outputted to the first motor 111 and the second motor 112 to control the angular positions of the holder 12M and the holder 12N as shown in FIG. 14A. In this example, the holder 12M and the holder 12N are retained in angular positions rotated by 54° in the reverse rotational direction d2 from the home position P3 (position located closest to the nip portion 23). By this operation, the magnetic fluxes directed from the induction coil 18 toward the blocks X1, X6 on the metal sleeve 11 are interrupted by the patterns that form the magnetic flux shield portions 32 of the holder 12M and the holder 12N. Therefore, only the blocks X2, X3, X4, X5 on the metal sleeve 11 are heated, and the generation of heat in the remaining blocks X1, X6 is restricted. Therefore, energy conservation can be achieved.

Concomitantly, the control section 100 operates as a second control section to control the on- and off-states of the power supply (by the high frequency power source section) to the induction coil 18 in synchronization with the conveyance of the sheet 14 through the nip portion 23 so that the areas corresponding to the data D11, D12, D13 of the sheet 14 are heated and the remaining areas corresponding to the data D14, D15, D16 are not heated. For example, the power supply to the induction coil 18 is turned on until the areas corresponding to the data D11, D12, D13 of the sheet 14 pass through the nip portion 23, and the power supply to the induction coil 18 is turned off while the areas corresponding to the data D14, D15, D16 pass through the nip portion 23. As a result, only the image region IA can be heated in the conveyance direction of the sheet 14. Therefore, further energy conservation can be achieved.

Strictly speaking, the present control possibly generates paper wrinkles as a consequence of the occurrence of a temperature difference between the first half portion and the latter half portion of the sheet 14. However, since the fall velocity of the temperature of the metal sleeve 11 is usually comparatively gradual in comparison with the conveyance speed of the sheet 14, it is considered that no trouble occurs.

Although the example of the control in FIGS. 14A through 14C has been in the case where an image is formed on one sheet 14, the present invention is also applied to the case of a multi print job (job to form images continuously on a plurality of sheets) as follows.

Figure 15:
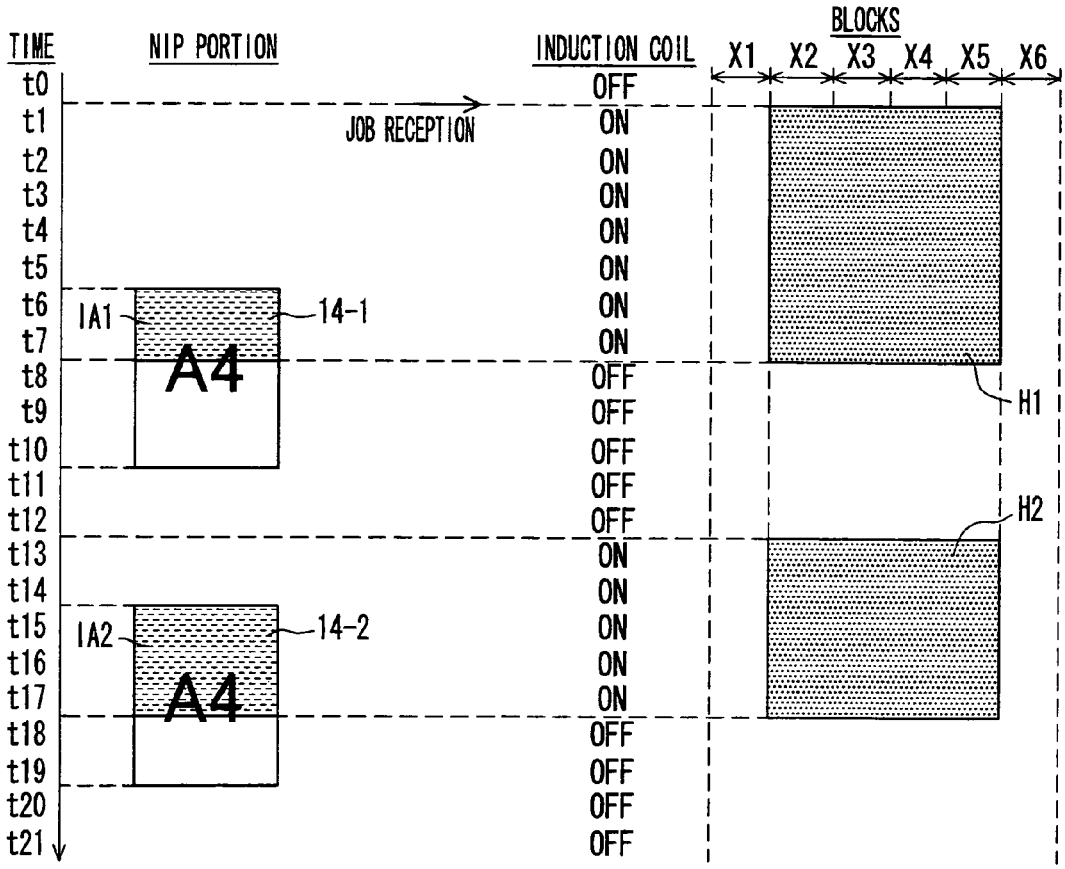
FIG. 15 is a view showing an example of control by a control section when sheets of A4 size are successively fed into a nip portion in portrait orientation by a multi print job.

FIG. 15 shows an example of control by the control section 100 in a case where particularly sheets 14-1, 14-2 of A4 size are successively fed in portrait orientation into the nip portion by the multi print job. A flow of times t0, t1, t2, . . . in certain units of time (hereinafter referred to as a "frame") is shown at the left-hand end of FIG. 15 (and so forth in FIGS. 16 and 17 described later).

As is apparent from FIG. 15, the sheet 14-1 passes through the nip portion during time t6 to t10, and the sheet 14-2 passes through the nip portion during time t15 to t19. It is noted that the conveyance speed of each sheet is constant. In this example, with regard to the conveyance direction of the sheet, only the area of the sheet 14-1 passing through the nip portion during time t6 to t7 is an image region IA1 to which the toner image has actually adhered, and only the area of the sheet 14-2 passing through the nip portion during time t15 to t17 is an image region IA2 to which the toner image has actually adhered. With regard to the widthwise direction of the sheet, the areas that belong to the image regions on the sheets 14-1 and 14-2 correspond to the blocks X2, X3, X4, X5 on the metal sleeve 11.

In this case, the control section 100 immediately turns on the power supply to the induction coil 18 upon receiving the job at time t1. The reason why the power supply to the induction coil 18 is immediately turned on is to perform control of preparatorily raising the temperature of (the sheet feed region of) the metal sleeve 11 to the target temperature by performing heating of five frames by time t6 when the first sheet 14-1 reaches the nip portion. By controlling the angular positions of the holder 12M and the holder 12N to the angular positions shown in FIG. 14A by the control section 100, a state in which only the blocks X2, X3, X4, X5 on the metal sleeve 11 are heated is provided. A timewise and spatial range of heating at this time is indicated by H1 in the figure. When the image region IA1 of the sheet 14-1 has passed through the nip portion, the control section 100 immediately turns off the power supply to the induction coil 18 (time t8). Subsequently, the control section 100 turns on the power supply to the induction coil 18 before the next sheet 14-2 reaches the nip portion (time t13). The reason for the above is to control the temperature of (the sheet feed region of) the metal sleeve 11 again to the target temperature by performing heating of two frames by time t15 when the sheet 14-2 reaches the nip portion. A timewise and spatial range of heating at this time is indicated by H2 in the figure. When the image region IA2 of the sheet 14-2 has passed through the nip portion, the control section 100 immediately turns off the power supply to the induction coil 18 (time t18).

By thus restricting the range of heating timewise and spatially, energy conservation can be achieved.

Figure 16:
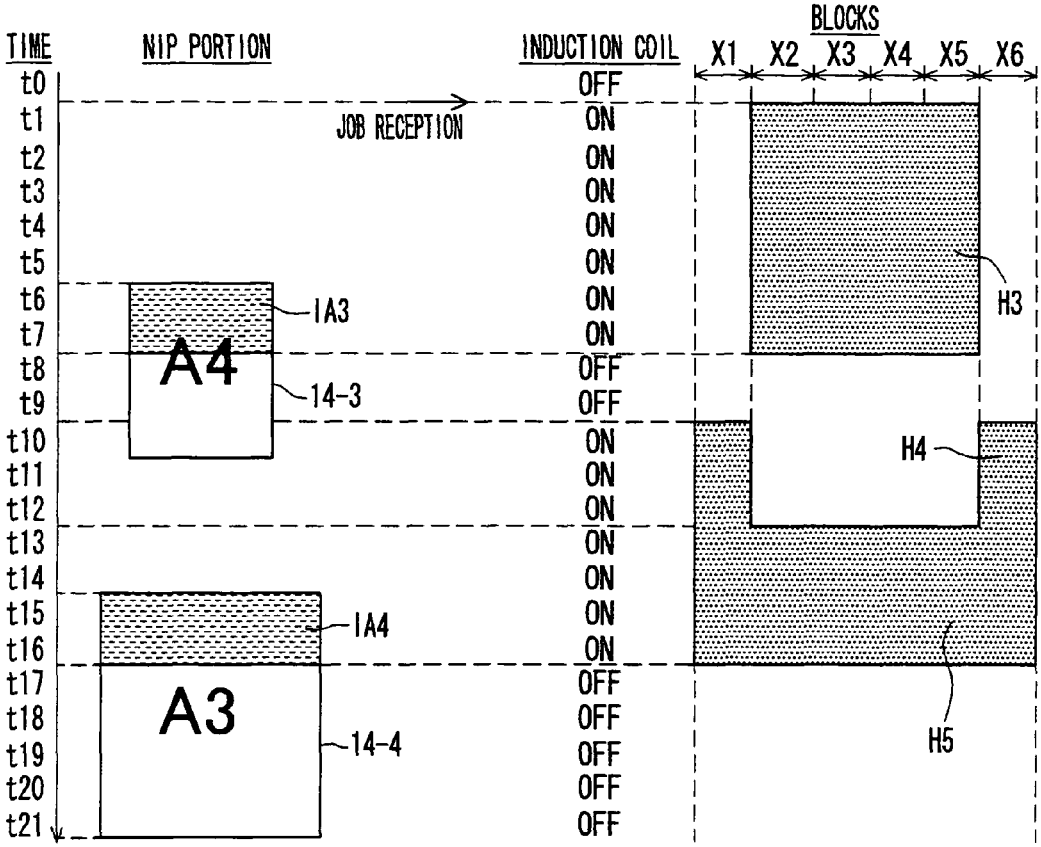
FIG. 16 is a view showing an example of control by the control section when, in particular, a sheet of A4 size and a sheet of A3 size are successively fed into the nip portion in portrait orientation by a multi print job.

FIG. 16 shows an example of control by the control section 100 in a case where particularly a sheet 14-3 of A4 size and a sheet 14-4 of A3 size are successively fed in portrait orientation into the nip portion by a multi print job.

As is apparent from 16, the sheet 14-3 passes through the nip portion during time t6 to t10, and the sheet 14-4 passes through the nip portion during time t15 to t21. It is noted that the conveyance speed of each sheet is constant. In this example, with regard to the conveyance direction of the sheet, only the area of the sheet 14-3 passing through the nip portion during time t6 to t7 is an image region IA3 to which the toner image has actually adhered, and only the area of the sheet 14-4 passing through the nip portion during time t15 to t16 is an image region IA4 to which the toner image has actually adhered. With regard to the widthwise direction of the sheet, the area that belongs to the image region on the sheet 14-3 corresponds to the blocks X2, X3, X4, X5 on the metal sleeve 11, and the area that belongs to the image region on the sheet 14-4 corresponds to all the blocks X1, X2, . . . , X6 on the metal sleeve 11.

In this case, the control section 100 immediately turns on the power supply to the induction coil 18 upon receiving the job at time t1. The reason why the power supply to the induction coil 18 is immediately turned on is to perform control of preparatorily raising the temperature of (the sheet feed region of) the metal sleeve 11 to the target temperature by performing heating of five frames by time t6 when the first sheet 14-3 reaches the nip portion. The control section 100 controls the angular positions of the holder 12M and the holder 12N to the angular positions shown in FIG. 14A. By this operation, a state in which only the blocks X2, X3, X4, X5 on the metal sleeve 11 are heated is provided. A timewise and spatial range of heating at this time is indicated by H3 in the figure. When the image region IA3 of the sheet 14-3 has passed through the nip portion, the control section 100 immediately turns off the power supply to the induction coil 18 (time t8).

Subsequently, the control section 100 turns on the power supply to the induction coil 18 before the next sheet 14-4 reaches the nip portion (time t10). Concomitantly, the control section 100 switches the angular positions of the holder 12M and the holder 12N so that only the blocks X1, X6 on the metal sleeve 11 are heated. In concrete, the angular position P1 of the holder 12M is rotated by 144° in the reverse rotational direction d2, and the angular position P2 of the holder 12N is rotated by 144° in the reverse rotational direction d2 with respect to the angular positions shown in FIG. 14A. The reason for the above is to perform control of preparatorily raising the temperatures of the blocks X1, X6 of the metal sleeve 11 to the target temperature by performing heating of five frames of the blocks X1, X6 of the metal sleeve 11 by time t15 when the sheet 14-4 reaches the nip portion. A timewise and spatial range of heating at this time is indicated by H4 in the figure.

At time t13, the control section 100 switches the angular positions of the holder 12M and the holder 12N to the home positions (see FIG. 6) so that all the blocks X1, X2, . . . , X6 on the metal sleeve 11 are heated. In concrete, the angular position P1 of the holder 12M is rotated by 90° in the forward rotational direction d1, and the angular position P2 of the holder 12N is rotated by 90° in the forward rotational direction d1 with respect to the immediately preceding angular positions. The reason for the above is to preparatorily control the temperatures of all the blocks X1, X2, . . . , X6 of the metal sleeve 11 to the target temperature by performing the heating of two frames of the blocks X2, . . . , X5 of the metal sleeve 11 by time t15 when the sheet 14-4 reaches the nip portion. A timewise and spatial range of heating at this time is indicated by H5 in the figure. When the image region IA4 of the sheet 14-4 has passed through the nip portion, the control section 100 immediately turns off the power supply to the induction coil 18 (time t17).

By thus restricting the range of heating timewise and spatially, energy conservation can be achieved.

Figure 17:
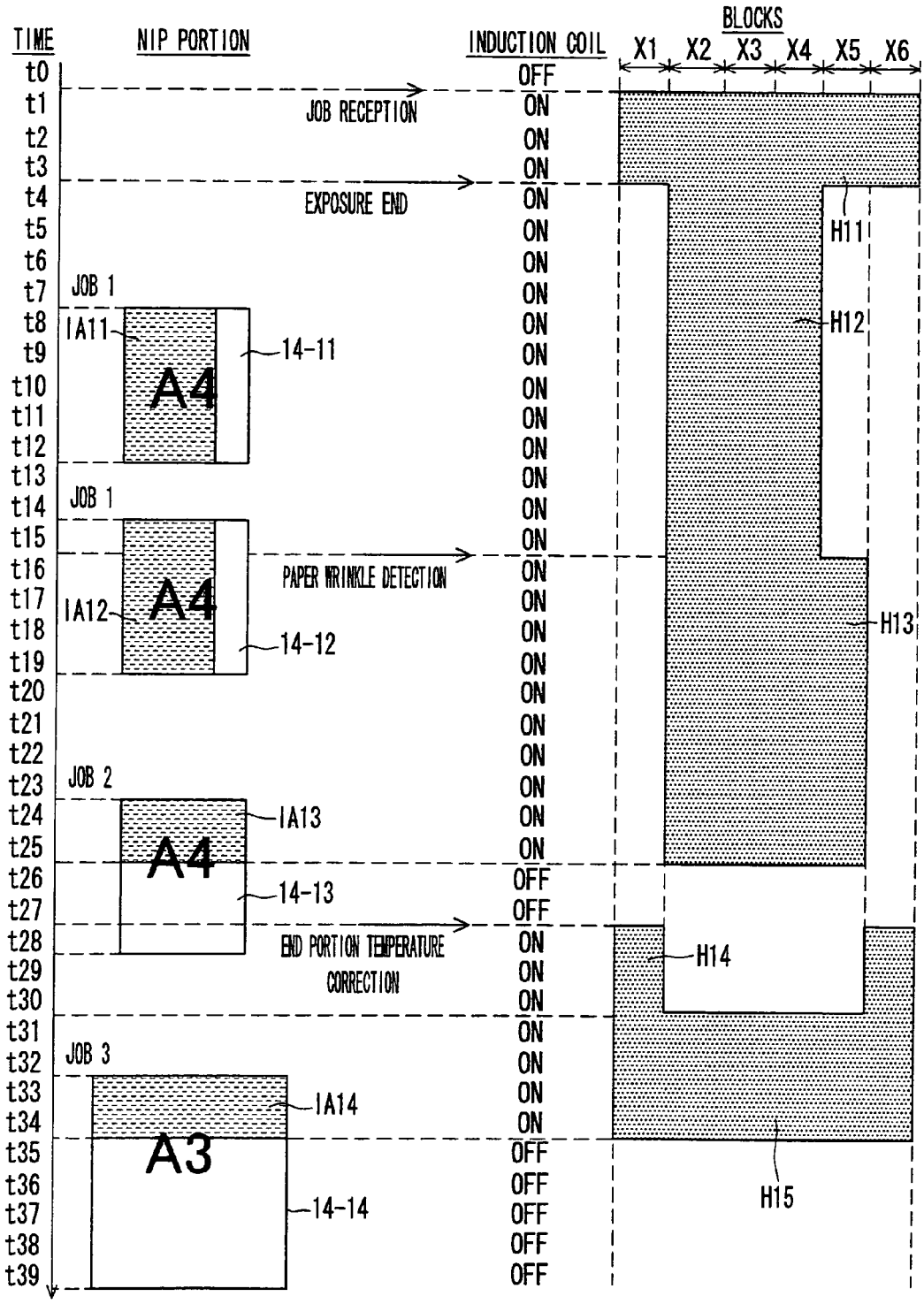
FIG. 17 is a view showing an example of control by the control section when, in particular, three sheets of A4 size and a sheet of A3 size are successively fed into the nip portion in portrait orientation by a multi print job.

FIG. 17 shows an example of control by the control section 100 in a case where particularly sheets 14-11, 14-12, 14-13 of A4 size and a sheet 14-14 of A3 size are successively fed in portrait orientation into the nip portion by a multi print job.

As is apparent from FIG. 17, the sheet 14-11 passes through the nip portion during time t8 to t12, the sheet 14-12 passes through the nip portion during time t15 to t19, the sheet 14-13 passes through the nip portion during time t24 to t28, and the sheet 14-14 passes through the nip portion during time t33 to t39. It is noted that the conveyance speed of each sheet is constant. In this example, with regard to the conveyance direction of the sheet, the whole area of the sheets 14-11, 14-12 of the job 1 (two copies) are image regions IA11, IA12 to which the toner images have actually adhered, and only the area of the sheet 14-13 passing through the nip portion during time t24 to t25 is an image region IA13 to which the toner image has actually adhered. Moreover, only the area of the sheet 14-14 passing through the nip portion during time t33 to t34 is an image region IA14 to which the toner image has actually adhered. With regard to the widthwise direction of the sheet, the areas that belong to the image regions on the sheets 14-11 and 14-12 correspond to the blocks X2, X3, X4 on the metal sleeve 11. The area that belongs to the image region on the sheet 14-13 corresponds to the blocks X2, X3, X4, X5 on the metal sleeve 11. Moreover, the area that belongs to the image region on the sheet 14-14 corresponds to all the blocks X1, X2, . . . , X6 on the metal sleeve 11.

In this case, the control section 100 turns on the power supply to the induction coil 18 immediately upon receiving the job 1 at time t1 in the standby state to control the angular positions of the holder 12M and the holder 12N to the home positions (see FIG. 6) so that all the blocks X1, X2, . . . , X6 on the metal sleeve 11 are heated by time t3 when exposure of the photoconductor to laser light ends. The reason for the above is to heat all the blocks of the metal sleeve 11 for the time being, since the image region cannot be found if image region detection is not performed in the standby state. A timewise and spatial range of heating at this time is indicated by H11 in the figure. Subsequently, at time t4 after the exposure of the photoconductor to light ends, the image region IA11 on the sheet 14-11 is identified by image region detection. At time t4, the control section 100 switches the angular positions of the holder 12M and the holder 12N from the home positions to the angular positions shown in FIG. 10A. By this operation, a state in which only the blocks X2, X3, X4 on the metal sleeve 11 are heated is provided. A timewise and spatial range of heating at this time is indicated by H12 in the figure. Since the job 1 is the print job of two copies, and all the areas of the sheets 14-11, 14-12 are the image regions IA11, IA12 in the conveyance direction of the sheet, it may be proper to maintain the heating of only the blocks X2, X3, X4 until time t19 when the whole area of the second sheet 14-12 passes through the nip portion, as fundamental control.

However, in this example, it is assumed that the difference ($T_{MAX}$–$T_{MIN}$) between the maximum temperature $T_{MAX}$ and the minimum temperature $T_{MIN}$ based on the temperatures detected by the thermistors Th1, Th2, . . . , Th6 (see FIG. 5) within the sheet feed region on the metal sleeve 11 has exceeded the prescribed threshold value (50° C. in this example) partway when the second sheet 14-12 is passing through the nip portion (time t16) (paper wrinkle detection). At this time, the control section 100 switches the angular positions of the holder 12M and the holder 12N to the angular positions shown in FIG. 14A. In concrete, the angular position P1 of the holder 12M is maintained with respect to the angular position shown in FIG. 10A, and the angular position P2 of the holder 12N is rotated by 36° in the reverse rotational direction d2. By this operation, a state in which the heating of the blocks X2, X3, X4, X5 on the metal sleeve 11 is permitted in correspondence with the whole sheet feed region on the metal sleeve 11, corresponding to the "A4 portrait" sheet feed in this example. A timewise and spatial range of heating at this time is indicated by H13 in the figure.

Even if the second sheet 14-12 of the job 1 has passed through the nip portion past the time t19, the control section 100 maintains the heating of the blocks X2, X3, X4, X5 without immediately turning off the power supply to the induction coil 18. The reason for the above is that the image region IA13 on the sheet 14-13 of the job 2 corresponds to the same blocks X2, X3, X4, X5 on the metal sleeve 11. When the image region IA13 of the sheet 14-13 has passed through the nip portion, the control section 100 immediately turns off the power supply to the induction coil 18 (time t25).

Subsequently, the control section 100 turns on the power supply to the induction coil 18 before the next sheet 14-14 reaches the nip portion (time t28). Concomitantly, the control section 100 switches the angular positions of holder 12M and the holder 12N so that only the blocks X1, X6 on the metal sleeve 11 are heated. In concrete, the angular position P1 of the holder 12M is rotated by 144° in the reverse rotational direction d2, and the angular position P2 of the holder 12N is rotated by 144° in the reverse rotational direction d2 with respect to the angular positions shown in FIG. 14A. The reason for the above is to perform control of preparatorily raising the temperatures of the blocks X1, X6 of the metal sleeve 11 to the target temperature by performing heating of five frames of the blocks X1, X6 of the metal sleeve 11 by time t33 when the sheet 14-14 reaches the nip portion (end portion temperature correction). A timewise and spatial range of heating at this time is indicated by H14 in the figure.

At time t31, the control section 100 switches the angular positions of the holder 12M and the holder 12N to the home positions (see FIG. 6) so that all the blocks X1, X2, . . . , X6 on the metal sleeve 11 are heated. In concrete, the angular position P1 of the holder 12M is rotated by 90° in the forward-rotational direction d1, and the angular position P2 of the holder 12N is rotated by 90° in the forward rotational direction d1 with respect to the immediately preceding angular positions. The reason for the above is to preparatorily control the temperatures of all the blocks X1, X2, . . . , X6 on the metal sleeve 11 to the target temperature by performing the heating of two frames of the blocks X2, . . . , X5 of the metal sleeve 11 by time t33 when the sheet 14-14 reaches the nip portion. A timewise and spatial range of heating at this time is indicated by H15 in the figure. When the image region IA14 of the sheet 14-14 has passed through the nip portion, the control section 100 immediately turns off the power supply to the induction coil 18 (time t35).

By thus restricting the range of heating timewise and spatially, energy conservation can be achieved.

Figure 18:
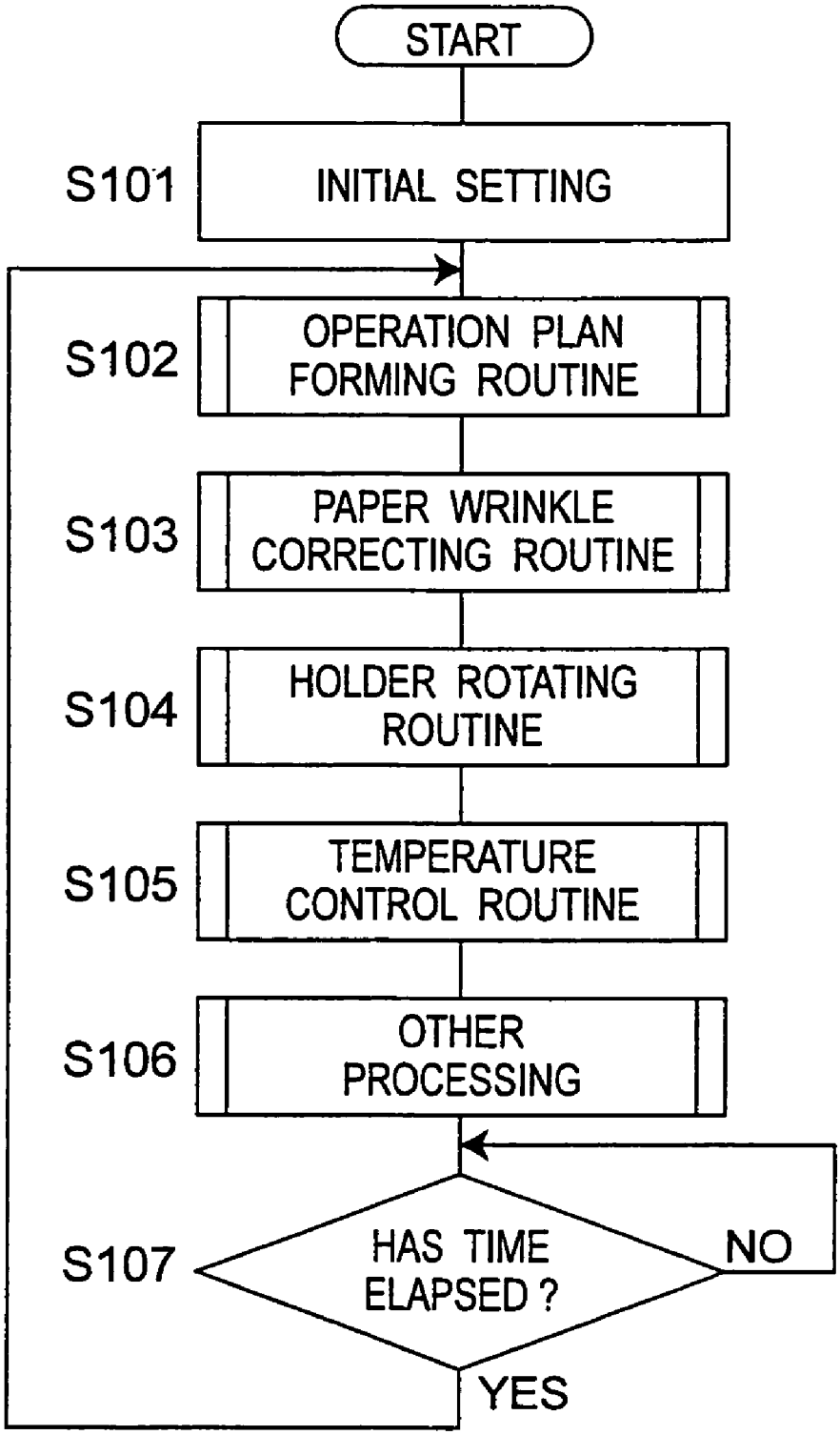
FIG. 18 is a schematic flow chart (main routine) of the control section for executing the control of FIG. 17.

FIG. 18 shows a general processing flow (main routine) of the control section 100 to perform the control of FIG. 17.

When the control section (CPU) 100 is reset to start the program, initial setting of the CPU, peripheral circuits and products are executed in S101. Subsequently, an operation plan forming routine (S102), a paper wrinkle correcting routine (S103), a holder rotating routine (S104) and a temperature control routine (S105) are sequentially executed. Moreover, sheet conveyance, electrophotography process control, operation panel control and so on are executed as other processing (S106). Then, one routine ends in S107 after awaiting for the end of the time measured by a reference timer (not shown). The reference timer is set to, for example, 10 ms, and timers for controlling the image forming apparatus of the present embodiment are counted by multiples of the reference timer.

Figure 19A:
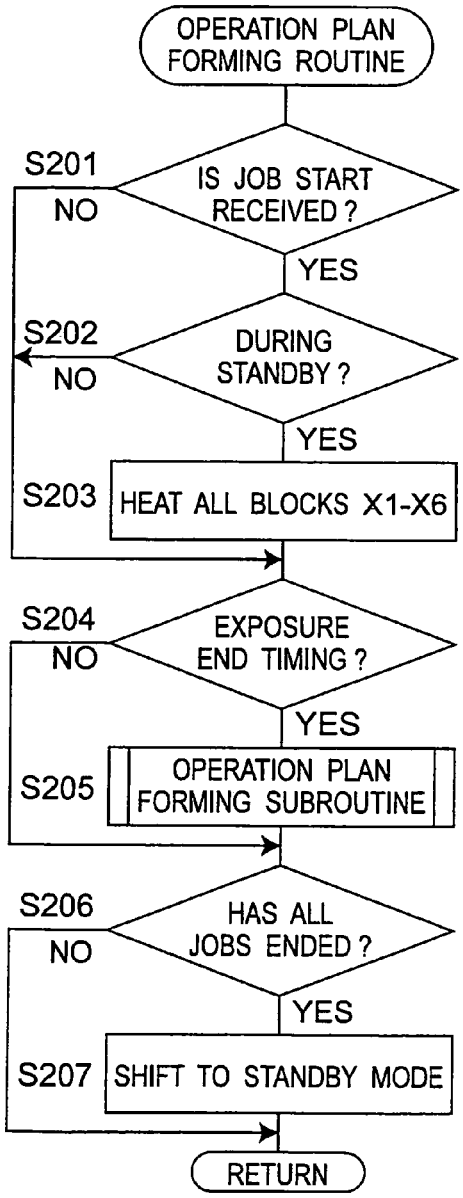
FIG. 19A is a chart showing a concrete processing flow for executing an operation plan forming routine in FIG. 18.
Figure 19B:
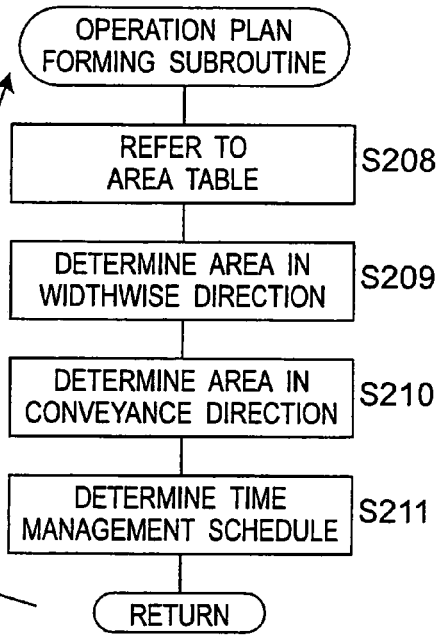
FIG. 19B is a chart showing a concrete processing flow for executing an operation plan forming subroutine in FIG. 18.

FIGS. 19A and 19B show a concrete processing flow for executing the operation plan forming routine (S102 in FIG. 18).

When job start is received from a personal computer (PC) or the like (not shown) on the network in S201 in FIG. 19A, it is determined whether or not the image forming apparatus is in a standby state in S202. Since it is supposed that the temperature of the metal sleeve 11 (fixing member) is low when job start is received in the standby state, control of heating all the blocks X1, X2, . . . , X6 on the metal sleeve 11 is executed in S203 (during time t1 to t3 in FIG. 17). Next, since the dot counting of the toner to be subjected to development and transfer ends when the exposure of the photoconductor to laser light ends in S204, an operation plan forming subroutine is executed in S205. It is determined whether or not all the jobs have ended in S206, and the program flow proceeds to a standby mode in S207 when it is determined that the jobs have ended. It is noted that the standby mode in the operation plan forming routine means a mode in which the power supply to the induction coil 18 is turned off.

As shown in FIG. 19B, in the operation plan forming subroutine, by referring to the data D1 through D6 and D11 through D19 of the area table 190 (see FIG. 8) in S208, the heating area in the widthwise direction of the sheet is determined in S209, and the heating area in the conveyance direction of the sheet is determined in S210. Further, a schedule for managing the time of the power supply to the induction coil 18, such as a heating method to be carried out when the sheet is passing through the nip portion 23 or before the next sheet is fed into the nip portion 23, is determined in S211.

Figure 20A:
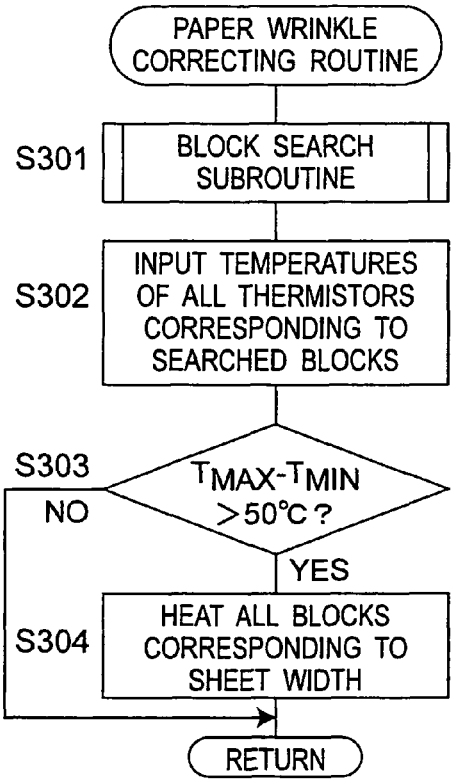
FIG. 20A is a chart showing a concrete processing flow for executing an paper wrinkle correcting routine in FIG. 18.
Figure 20B:
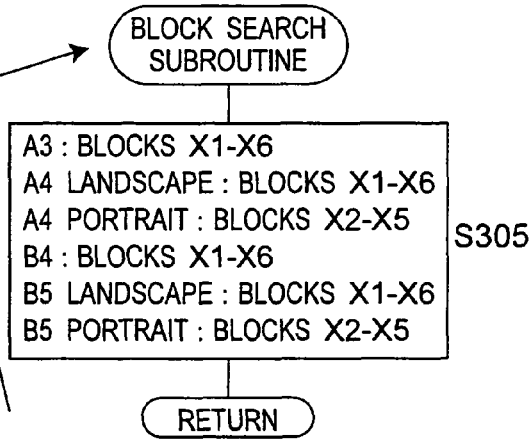
FIG. 20B is a chart showing a concrete processing flow for executing a block search subroutine in FIG. 20A.

FIGS. 20A and 20B show a concrete processing flow for executing the paper wrinkle correcting routine (S103 in FIG. 18).

In S301 of FIG. 20A, a block search subroutine for preparatorily obtaining the region of the metal sleeve 11 (i.e., sheet feed region) through which the sheet being currently conveyed passes is executed. In concrete, as shown in S305 of FIG. 20B, the blocks on the metal sleeve 11 are obtained on the basis of the width dimension of the sheet conveyed. For example, the sheets of A3 size and B4 size are conveyed consistently in portrait orientation, and all the blocks X1, X2, . . . , X6 are the sheet feed regions. When a sheet of A4 size is conveyed in landscape orientation ("A4 landscape" sheet feed) and when a sheet of B5 size is conveyed in landscape orientation ("B5 landscape" sheet feed), all the blocks X1, X2, . . . , X6 are the sheet feed regions. Moreover, when a sheet of A4 size is conveyed in portrait orientation ("A4 portrait" sheet feed) and when a sheet of B5 size is conveyed in portrait orientation ("B5 portrait" sheet feed), the blocks X2, . . . , X5 are the sheet feed regions. Next, in S302 of FIG. 20A, the control section 100 inputs the temperatures of the thermistors corresponding to all the blocks within the obtained sheet feed region among the plurality of thermistors Th1, Th2, . . . , Th6. Next, in S303, the difference ($T_{MAX}-T_{MIN}$) between the maximum temperature $T_{MAX}$ and the minimum temperature $T_{MIN}$ is obtained within the sheet feed region on the metal sleeve 11, and it is determined whether or not the difference ($T_{MAX}-T_{MIN}$) exceeds the prescribed threshold value (50° C. in this example). When the difference ($T_{MAX}-T_{MIN}$) exceeds 50° C., the control of permitting the heating of the whole area of the sheet feed region of the metal sleeve 11 (paper wrinkle correction) is executed. By this operation, wrinkles can be prevented from generating in the sheet after fixation.

It is noted that the temperature difference (50° C. in this example) serving as the criterion of determination in S303 may be set not fixed but variable. Moreover, the difference may be allowed to be set according to the kind and the thickness of the sheet to be conveyed.

With regard to temperature control in the axial direction of the metal sleeve 11, it is sometimes the case where the system of providing a thermistor for each block as in the present embodiment becomes disadvantageous from the viewpoint of parts cost as a consequence of an increase in the number of necessary thermistors when more minute blocks are set for improvement in control accuracy. In such a case, it is possible to execute control equivalent to that in the case where many thermistors are employed, by preparatorily storing the quantity of heat to be absorbed by the sheet and so on in heating blocks and non-heating blocks as data and carrying out simulation in consideration of environments such as the temperature and humidity of the place where the fixing device is installed. With this arrangement, parts cost can be reduced with a reduction in the number of temperature sensors.

Figure 21:
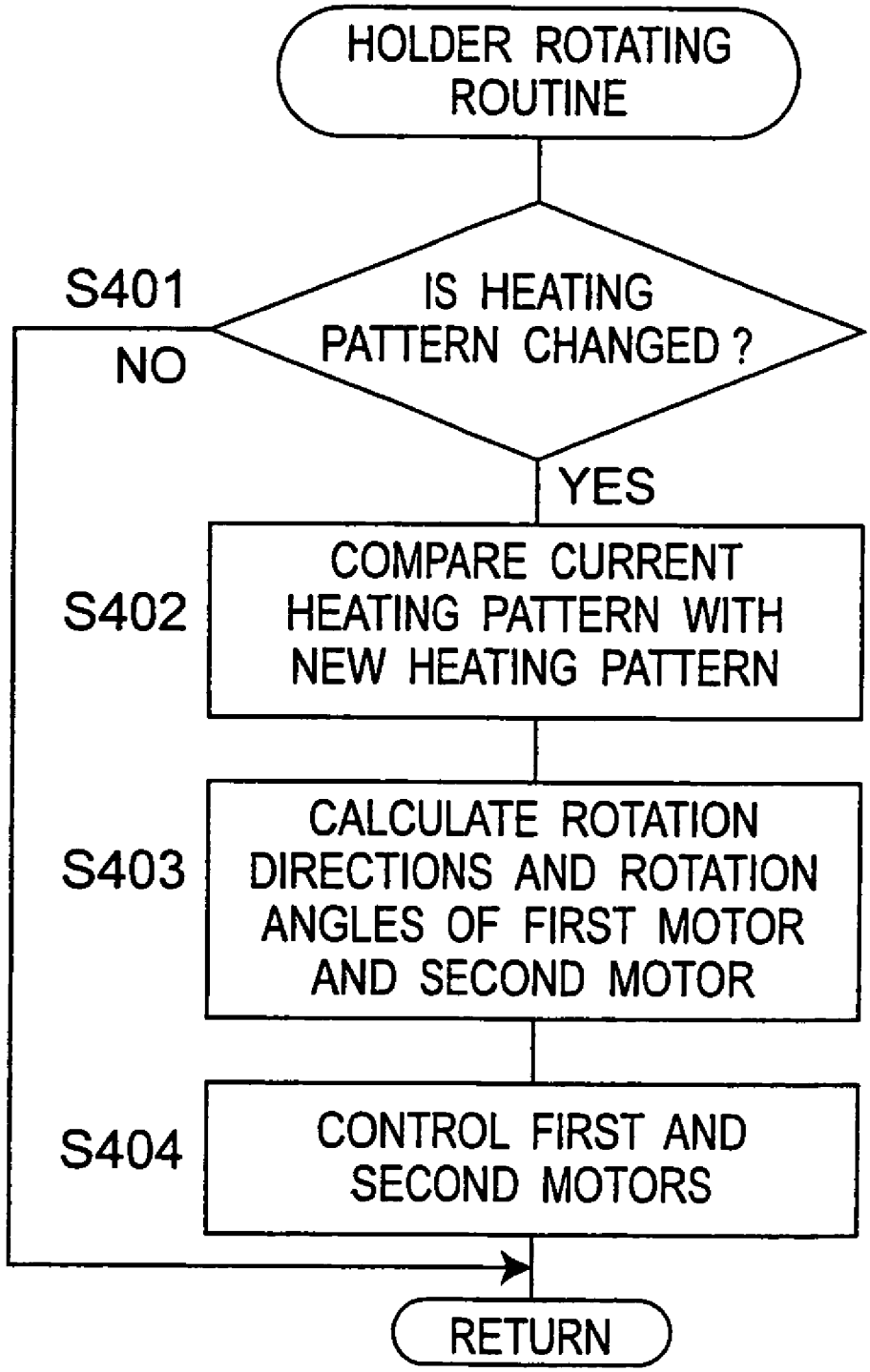
FIG. 21 is a chart showing a concrete processing flow for executing a holder rotating routine in FIG. 18.

FIG. 21 shows a concrete processing flow for executing the holder rotating routine (S104 in FIG. 18).

First of all, it is determined in S401 whether or not the heating pattern should be changed, i.e., it is determined whether or not the range of heating on the metal sleeve 11 should be changed on the basis of the image region detection result in the widthwise direction of the sheet conveyed. In this case, when the heating pattern should be changed, the program flow proceeds to S402 to compare the current heating pattern with a new heating pattern to substitute for the pattern. Next, the directions of rotation and the angles of rotation of the first motor 111 and the second motor 112 are calculated in S403 on the basis of the comparison result in order to rotate the holder 12M and the holder 12N. Then, the first motor 111 and the second motor 112 are controlled in S404 to rotate the holder 12M and the holder 12N by the obtained angles of rotation in the obtained directions of rotation.

Figure 22:
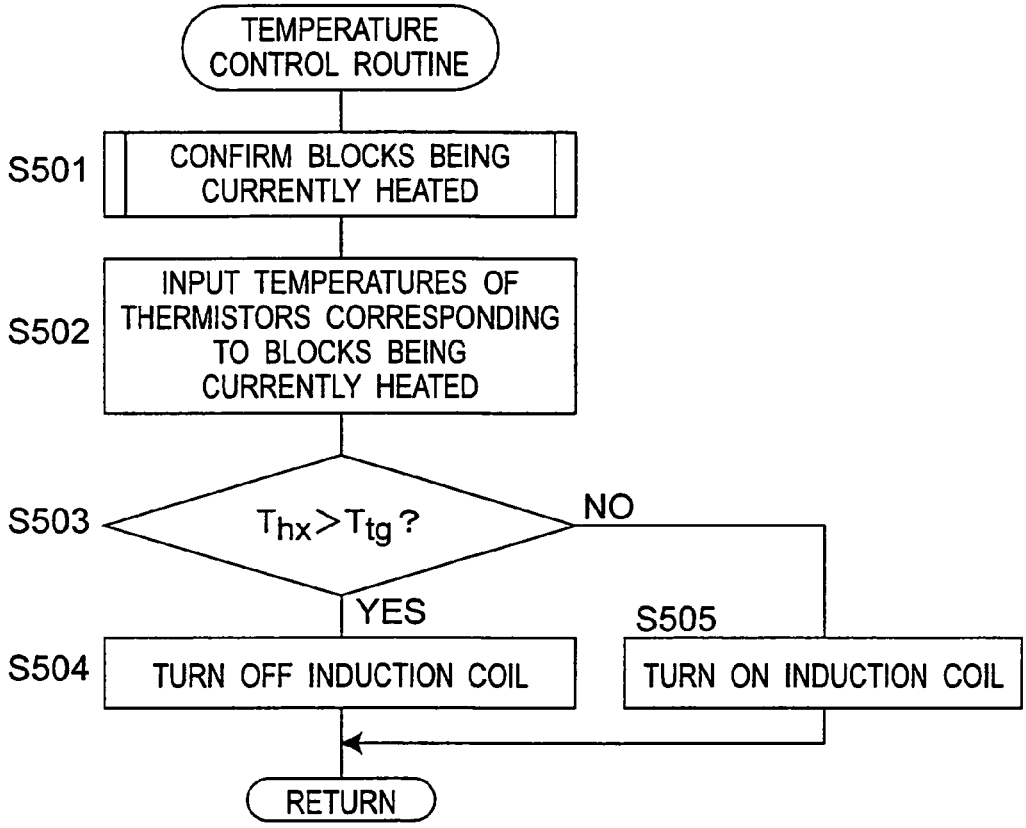
FIG. 22 is a chart showing a concrete processing flow for executing a temperature control routine in FIG. 18.

FIG. 22 shows a concrete processing flow for executing the temperature control routine (S105 in FIG. 18).

First of all, the blocks being currently heated on the metal sleeve 11 are confirmed in S501. The temperatures of the thermistors corresponding to the blocks being currently heated are inputted in S502. For example, when the blocks X2, . . . , X5 are being currently heated, the temperatures (data) detected by the thermistors Th2, Th3, Th4, Th5 are inputted. Since all the detection temperatures fundamentally express almost same temperatures, it is acceptable to input only the temperature of one representative thermistor (e.g., the thermistor Th2 or Th3 located almost in the center portion in the axial direction of the metal sleeve 11). Next, the inputted thermistor temperature Thx is compared with a preset target temperature (temperature necessary for fixation) Ttg in S503. In this case, when the thermistor temperature Thx is higher than the target temperature Ttg, the program flow proceeds to S504 to turn off the induction coil. When the thermistor temperature Thx is lower than the target temperature Ttg, the program flow proceeds to S505 to turn on the induction coil. The temperature of the metal sleeve 11 is thus controlled to the target temperature Ttg.

The invention being thus described, it will be obvious that the same may be varied in many ways. Such variations are not be regarded as a departure from the spirit and scope of the invention, and all such modifications as would be obvious to one skilled in the art are intended to be included within the scope of the following claims.

What is claimed is:

1. A fixing device comprising:

a fixing member that extends along a widthwise direction of a sheet conveyed and has an outer peripheral surface to be brought in pressure contact with the sheet;

an induction coil that is placed elongate in the widthwise direction of the sheet along the fixing member, for inductively heating a heat generating layer of the fixing member;

a high frequency power source section that heats the heat generating layer of the fixing member via the induction coil by supplying an alternating current to the induction coil;

a magnetic flux regulating section that restricts heating of a specified region of the fixing member in the widthwise direction of the sheet;

a first image region detecting section that detects an image region on the sheet occupied by an image to be fixed in the widthwise direction of the sheet; and a first control section that specifies a region in which generation of heat should be restricted for the magnetic flux regulating section so that only a region of the fixing member corresponding to the image region is substantially heated in the widthwise direction of the sheet, sheet-by-sheet according to a result of detection of the first image region detecting section; wherein the magnetic flux regulating section comprises:

a support member made of a nonmagnetic material placed elongate in the widthwise direction of the sheet along the fixing member and the induction coil;

a magnetic flux shield portion that is formed with a prescribed pattern on a surface of the support member and interrupts a magnetic flux directed from the induction coil toward the fixing member; and a displacement mechanism that displaces the support member having the magnetic flux shield portion relatively to the fixing member and the induction coil; wherein the fixing member is a metal sleeve that extends elongate in the widthwise direction of the sheet, the support member is a cylindrical member placed so as to be brought in contact with an inner peripheral surface of the fixing member, the induction coil is placed inside the support member, the support member is divided into a first support member and a second support member in the widthwise direction of the sheet, and the magnetic flux shield portion is provided for each of the first support member and the second support member, and the displacement mechanism displaces the first support member and the second support member of the support member by independently rotating the members around a central axis of each of the members.

2. The fixing device as claimed in claim 1 comprising:

a second image region detecting section that detects an image region on the sheet occupied by an image to be fixed in a conveyance direction of the sheet; and a second control section that specifies turning-on and -off of power supply to the induction coil for the high frequency power source section so that only the image region on the sheet is heated in the conveyance direction of the sheet, sheet-by-sheet according to a result of detection of the second image region detecting section.

3. The fixing device as claimed in claim 2, wherein the second image region detecting section comprises:

a counting section that comparts the sheet into a plurality of areas in the conveyance direction of the sheet and detects an amount of image of each comparted area;

a memory section that stores the amount of image of each area detected by the counting section; and a determining section that determines whether or not the amount of image of each area exceeds a prescribed threshold value and determines that such an area where the amount of image exceeds the threshold value belongs to the image region.

4. The fixing device as claimed in claim 1, wherein the pattern of the magnetic flux shield portion on the first support member comprises: a first pattern portion whose dimension in the direction of the central axis is gradually decreased from its total length as located farther away from a reference position on the support member toward one side in a circumferential direction; and a second pattern portion whose dimension in the direction of the central axis is gradually increased from zero to the total length as located farther away from the reference position toward the other side in the circumferential direction, the pattern of the magnetic flux shield portion on the second support member is formed symmetrically to the pattern of the magnetic flux shield portion on the first support member with respect to a boundary plane located between the first support member and the second support member, and the displacement mechanism is able to independently rotate the first support member and the second support member forwardly or reversely.

5. The fixing device as claimed in claim 4, wherein the first image region detecting section comparts the sheet into a plurality of areas in the widthwise direction of the sheet and detects whether or not each comparted area is occupied by the image that should be fixed, and each of the first and second patterns of the magnetic flux shield portion on the first support member and the second support member has the dimension in the direction of the central axis increased or decreased step-by-step in blocks defined in correspondence with the area as located farther away from the reference position in the circumferential direction.

6. The fixing device as claimed in claim 4, wherein each of the first and second patterns of the magnetic flux shield portion on the first support member and the second support member has the dimension in the direction of the central axis linearly increased or decreased as located farther away from the reference position in the circumferential direction.

7. The fixing device as claimed in claim 1, wherein the first image region detecting section comprises:

a counting section that comparts the sheet into a plurality of areas in the widthwise direction of the sheet and detects an amount of image of each comparted area;

a memory section that stores the amount of image of each area detected by the counting section; and a determining section that determines whether or not the amount of image of each area exceeds a prescribed threshold value and determines that such an area where the amount of image exceeds the threshold value belongs to the image region.

8. The fixing device as claimed in claim 1, comprising:

a temperature distribution obtaining section that obtains a temperature distribution of the fixing member in the widthwise direction of the sheet;

a passing region detecting section that preparatorily obtains a sheet passing region, through which the sheet should pass, of the fixing member sheet-by-sheet on a basis of a width dimension of the sheet conveyed; and a third control section that obtains a difference between a maximum temperature and a minimum temperature represented by the temperature distribution within the sheet passing region and permits the magnetic flux regulating section to heat whole area of the sheet passing region on the fixing member when the difference exceeds a prescribed threshold value.

9. The fixing device as claimed in claim 8, wherein the temperature distribution obtaining section comprises a plurality of temperature sensors that are arranged in the widthwise direction of the sheet oppositely to the fixing member and each detect a temperature of an opposite portion of the fixing member.

10. The fixing device as claimed in claim 8, wherein the temperature distribution obtaining section obtains by simulation a temperature distribution of the fixing member in the widthwise direction of the sheet.

11. An image forming apparatus comprising:

an image forming section that forms a toner image by making toner adhere to a sheet;

a fixing member that extends along a widthwise direction of the sheet conveyed and has an outer peripheral surface brought in pressure contact with the sheet to which the toner image has adhered;

an induction coil that is placed elongate in the widthwise direction of the sheet along the fixing member, for inductively heating a heat generating layer of the fixing member;

a high frequency power source section that heats the heat generating layer of the fixing member via the induction coil by supplying an alternating current to the induction coil;

a magnetic flux regulating section that restricts heating of a specified region of the fixing member in the widthwise direction of the sheet;

a first image region detecting section that detects an image region on the sheet occupied by an image to be fixed in the widthwise direction of the sheet; and a first control section that specifies a region in which generation of heat should be restricted for the magnetic flux regulating section so that only a region corresponding to the image region of the fixing member is substantially heated in the widthwise direction of the sheet, sheet-by-sheet according to a result of detection of the first image region detecting section; wherein the magnetic flux regulating section comprises:

a support member made of a nonmagnetic material placed elongate in the widthwise direction of the sheet along the fixing member and the induction coil;

a magnetic flux shield portion that is formed with a prescribed pattern on a surface of the support member and interrupts a magnetic flux directed from the induction coil toward the fixing member;

a displacement mechanism that displaces the support member having the magnetic flux shield portion relatively to the fixing member and the induction coil; wherein the fixing member is a metal sleeve that extends elongate in the widthwise direction of the sheet, the support member is a cylindrical member placed so as to be brought in contact with an inner peripheral surface of the fixing member, the induction coil is placed inside the support member, the support member is divided into a first support member and a second support member in the widthwise direction of the sheet, and the magnetic flux shield portion is provided for each of the first support member and the second support member, and the displacement mechanism displaces the first support member and the second support member of the support member by independently rotating the members around a central axis of each of the members.

12. The image forming apparatus as claimed in claim 11 comprising:

a second image region detecting section that detects an image region on the sheet occupied by an image to be fixed in a conveyance direction of the sheet; and a second control section that specifies turning-on and -off of power supply to the induction coil for the high frequency power source section so that only the image region on the sheet is heated in the conveyance direction of the sheet, sheet-by-sheet according to a result of detection of the second image region detecting section.

13. The image forming apparatus as claimed in claim 12, wherein the second image region detecting section comprises:

a counting section that comparts the sheet into a plurality of areas in the conveyance direction of the sheet and detects an amount of image of each comparted area;

a memory section that stores the amount of image of each area detected by the counting section; and a determining section that determines whether or not the amount of image of each area exceeds a prescribed threshold value and determines that such an area where the amount of image exceeds the threshold value belongs to the image region.

14. The image forming apparatus as claimed in claim 11, wherein the pattern of the magnetic flux shield portion on the first support member comprises: a first pattern portion whose dimension in the direction of the central axis is gradually decreased from its total length as located farther away from a reference position on the support member toward one side in a circumferential direction; and a second pattern portion whose dimension in the direction of the central axis is gradually increased from zero to the total length as located farther away from the reference position toward the other side in the circumferential direction, the pattern of the magnetic flux shield portion on the second support member is formed symmetrical to the pattern of the magnetic flux shield portion on the first support member with respect to a boundary plane located between the first support member and the second support member, and the displacement mechanism is able to independently rotate the first support member and the second support member forwardly or reversely.

15. The image forming apparatus as claimed in claim 14, wherein the first image region detecting section comparts the sheet into a plurality of areas in the widthwise direction of the sheet and detects whether or not each comparted area is occupied by the image that should be fixed, and each of the first and second patterns of the magnetic flux shield portion on the first support member and the second support member has the dimension in the direction of the central axis increased or decreased step-by-step in blocks defined in correspondence with the area as located farther away from the reference position in the circumferential direction.

16. The image forming apparatus as claimed in claim 14, wherein each of the first and second patterns of the magnetic flux shield portion on the first support member and the second support member has the dimension in the direction of the central axis continuously increased or decreased as located farther away from the reference position in the circumferential direction.

17. The image forming apparatus as claimed in claim 11, wherein the first image region detecting section comprises:

a counting section that comparts the sheet into a plurality of areas in the widthwise direction of the sheet and detects an amount of image of each comparted area;

a memory section that stores the amount of image of each area detected by the counting section; and a determining section that determines whether or not the amount of image of each area exceeds a prescribed threshold value and determines that such an area where the amount of image exceeds the threshold value belongs to the image region.

18. The image forming apparatus as claimed in claim 11, comprising:

a temperature distribution obtaining section that obtains a temperature distribution of the fixing member in the widthwise direction of the sheet;

a passing region detecting section that preparatorily obtains a sheet passing region, through which the sheet should pass, of the fixing member sheet-by-sheet on a basis of a width dimension of the sheet conveyed; and a third control section that obtains a difference between a maximum temperature and a minimum temperature represented by the temperature distribution within the sheet passing region and permits the magnetic flux regulating section to heat whole area of the sheet passing region on the fixing member when the difference exceeds a prescribed threshold value.

19. The image forming apparatus as claimed in claim 18, wherein the temperature distribution obtaining section comprises a plurality of temperature sensors that are arranged in the widthwise direction of the sheet oppositely to the fixing member and each detect a temperature of an opposite portion of the fixing member.

20. The image forming apparatus as claimed in claim 18, wherein the temperature distribution obtaining section obtains by simulation a temperature distribution of the fixing member in the widthwise direction of the sheet.

* * * * *